US010913283B2

(12) United States Patent
Hayashi et al.

(10) Patent No.: US 10,913,283 B2
(45) Date of Patent: Feb. 9, 2021

(54) IMAGE-RECORDING APPARATUS INCLUDING WALL PORTION PROVIDED IN STORAGE CHAMBER OF TANK CONNECTABLE TO LIQUID CARTRIDGE

(71) Applicant: BROTHER KOGYO KABUSHIKI KAISHA, Nagoya (JP)

(72) Inventors: Masahiro Hayashi, Nagoya (JP); Yuma Tanabe, Nagoya (JP); Akinari Ishibe, Okazaki (JP); Masatake Sato, Nagoya (JP); Akihito Kobayashi, Konan (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/247,724

(22) Filed: Jan. 15, 2019

(65) Prior Publication Data

US 2019/0143706 A1 May 16, 2019

Related U.S. Application Data

(63) Continuation of application No. 15/881,880, filed on Jan. 29, 2018, now Pat. No. 10,207,512.

(30) Foreign Application Priority Data

Jan. 31, 2017 (JP) ..... 2017-016375

(51) Int. Cl.
*B41J 2/175* (2006.01)
*B41J 2/045* (2006.01)
(Continued)

(52) U.S. Cl.
CPC ..... *B41J 2/17566* (2013.01); *B41J 2/04561* (2013.01); *B41J 2/04581* (2013.01);
(Continued)

(58) Field of Classification Search
CPC ..... B41J 2/04561; B41J 2/04581; B41J 2/17509; B41J 2/17513; B41J 2/1752;
(Continued)

(56) References Cited

U.S. PATENT DOCUMENTS 5,790,158 A * 8/1998 Shinada ..... B41J 2/175 347/86
6,003,985 A * 12/1999 Bekki ..... B41J 2/17513 347/108
(Continued)

FOREIGN PATENT DOCUMENTS

JP 2005-342992 A 12/2005
JP 2008-230162 A 10/2008
(Continued)

OTHER PUBLICATIONS

Office Action issued in corresponding Japanese Patent Application No. 2017-016375, Dec. 1, 2020.

*Primary Examiner* — Anh T Vo
(74) *Attorney, Agent, or Firm* — Merchant & Gould P.C.

(57) ABSTRACT

An image-recording apparatus includes a cartridge including a first storage chamber, a tank including a second storage chamber, a recording portion, a detected portion, a detector, and a wall portion. Liquid supplied from the first storage chamber to the second storage chamber through an inlet port is supplied from the second storage chamber to the recording portion through an outlet port. The wall portion partitions an internal space of the second storage chamber into a first region including the liquid inlet port and a second region including the detected portion. The wall portion extends upward than the liquid inlet port and the detected portion and downward than the liquid inlet port and the detected portion. Communication between the first region and the second region is allowed through upper and lower communication
(Continued)

portions. The upper communication portion is positioned upward than the liquid inlet port and the detected portion.

19 Claims, 12 Drawing Sheets

(51) Int. Cl.
*B41J 29/13* (2006.01)
*B41J 29/38* (2006.01)

(52) U.S. Cl.
CPC ..... *B41J 2/1752* (2013.01); *B41J 2/17509* (2013.01); *B41J 2/17513* (2013.01); *B41J 2/17523* (2013.01); *B41J 2/17526* (2013.01); *B41J 2/17553* (2013.01); *B41J 29/13* (2013.01); *B41J 29/38* (2013.01); *B41J 2002/17569* (2013.01); *B41J 2002/17573* (2013.01)

(58) Field of Classification Search
CPC ..... B41J 2/17523; B41J 2/17526; B41J 2/17553; B41J 2/17566; B41J 29/13; B41J 29/38; B41J 2002/17569; B41J 2002/17573
See application file for complete search history.

(56) References Cited

U.S. PATENT DOCUMENTS

| | | | | |
|---|---|---|---|---|
| 6,086,193 | A * | 7/2000 | Shimada | B41J 2/17503 347/86 |
| 6,257,712 | B1 * | 7/2001 | Haigo | B41J 2/175 347/85 |
| 6,520,630 | B1 | 2/2003 | Oda et al. | |
| 7,293,850 | B2 * | 11/2007 | Yamamoto | B41J 2/17513 347/7 |
| 7,726,793 | B2 * | 6/2010 | Yamamoto | B41J 2/17566 347/86 |
| 8,408,687 | B2 | 4/2013 | Nishioka et al. | |
| 2004/0119796 | A1 * | 6/2004 | Kumagai | B41J 2/17509 347/85 |
| 2005/0270347 | A1 | 12/2005 | Yamamoto | |
| 2006/0268077 | A1 * | 11/2006 | Shinada | B41J 2/17566 347/85 |
| 2012/0182364 | A1 | 7/2012 | Takeda et al. | |
| 2012/0262515 | A1 * | 10/2012 | Karasawa | B41J 2/1752 347/19 |
| 2015/0109379 | A1 | 4/2015 | Koike | |

FOREIGN PATENT DOCUMENTS

| | | |
|---|---|---|
| JP | 2010-76392 A | 4/2010 |
| JP | 2010-94847 A | 4/2010 |
| JP | 2016-83914 A | 5/2016 |

* cited by examiner

IMAGE-RECORDING APPARATUS INCLUDING WALL PORTION PROVIDED IN STORAGE CHAMBER OF TANK CONNECTABLE TO LIQUID CARTRIDGE

CROSS REFERENCE TO RELATED APPLICATION

This application claims is a continuation of U.S. patent application Ser. No. 15/881,880, filed Jan. 29, 2018, which further claims priority from Japanese Patent Application No. 2017-016375 filed on Jan. 31, 2017. The entire contents of both applications are incorporated herein by reference.

TECHNICAL FIELD

The present disclosure relates to an image-recording apparatus provided with a liquid chamber and capable of detecting a residual amount of liquid stored in the liquid chamber.

BACKGROUND

There is known a conventional image-recording apparatus including an ink tank configured to store ink therein. For example, Japanese Patent Application Publication No. 2005-342992 discloses such an ink tank within which a detected portion is disposed. The detected portion is configured to be detected by a detector to detect a residual amount of ink in a storage chamber in the ink tank.

In this ink tank, the detected portion is disposed at a lower end of the storage chamber. With this structure, the detector can detect that the storage chamber is empty.

Further, in this ink thank, a wall is provided within the storage chamber. One surface of the wall is arranged to face a communication port through which air bubbles are configured to flow into the storage chamber from outside. The other surface of the wall is arranged to face the detector. The air bubbles flowing into the storage chamber abuts on the surface of the wall, enabling a reduced amount of air bubbles to reach the detector. As a result, this structure can reduce a probability that the detector may incorrectly detect little ink is left in the storage chamber due to adherence of air bubbles to the detected portion even if a certain amount of ink is still left in the storage chamber.

SUMMARY

In the above ink tank, the wall partitions the storage chamber into two separate spaces. However, the two spaces are allowed to communicate with each other with an opening formed in the lower end of the wall. That is, the opening is formed at the same height as the detected portion. Hence, air bubbles flowing into the storage chamber may move horizontally through the opening to be adhered to the detected portion. The air bubbles adhered to the detected portion may possibly cause incorrect detection by the detector as described above.

Further, assume that this image-recording apparatus includes a cartridge-attachment portion having a second storage chamber (corresponding to the above storage chamber of the ink tank), and a cartridge having a first storage chamber is made detachably attachable to this cartridge-attachment portion. In this configuration, the cartridge needs to be replaced with new one if ink stored in the first storage chamber is depleted. Accordingly, in this image-recording apparatus, the detector disposed within the second storage chamber may be configured to detect whether or not the first storage chamber is empty, rather than whether the second storage chamber is empty. As the amount of ink left in the first storage chamber becomes smaller, air bubbles may be more likely to enter into the second storage chamber from the first storage chamber. If these air bubbles may adhere to the detected portion disposed in the second storage chamber, the detector may incorrectly detect that a certain amount of ink is still left in the first storage chamber despite the fact that actually little ink is left in the first storage chamber.

In view of the foregoing, it is an object of the disclosure to provide an image-recording apparatus capable of suppressing incorrect detection of a residual amount of liquid stored in a cartridge.

In order to attain the above and other objects, according to one aspect, the disclosure provides an image-recording apparatus including a cartridge, a tank, a recording portion, a detected portion and a wall portion. The cartridge includes: a first storage chamber configured to store liquid; and a first air communication passage configured to allow the first storage chamber to communicate with an atmosphere. The tank is connectable to the cartridge and includes: a liquid inlet port through which the liquid stored in the first storage chamber is configure to be introduced; a second storage chamber configured to store the liquid introduced thereinto from the first storage chamber through the liquid inlet port; a liquid outlet port configured to discharge the liquid stored in the second storage chamber to flow out therefrom; and a second air communication passage configured to allow the second storage chamber to communicate with the atmosphere. The recording portion includes a nozzle through which the liquid supplied from the second storage chamber through the liquid outlet port is configured to be ejected in a form of liquid droplets. The detected portion is disposed in the second storage chamber, the detected portion being configured to change in state in a case where a liquid level of the liquid stored in the second storage chamber becomes equal to or lower than a position of the liquid inlet port in a vertical direction. The detector is configured to detect change in state of the detected portion and output a detection signal upon detection of the change. The wall portion partitions an inner space of the second storage chamber into a first region and a second region, the liquid inlet port being provided in the first region and the detected portion being provided in the second region. The wall portion extends from a position upward relative to the liquid inlet port and the detected portion to a position downward relative to the liquid inlet port and the detected portion in the vertical direction. The first region and the second region are allowed to communicate with each other through an upper communication portion and a lower communication portion. The lower communication portion is formed in a lower end portion of the wall portion in the vertical direction. The upper communication portion is positioned upward relative to the liquid inlet port, the detected portion and the lower communication portion.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1A:
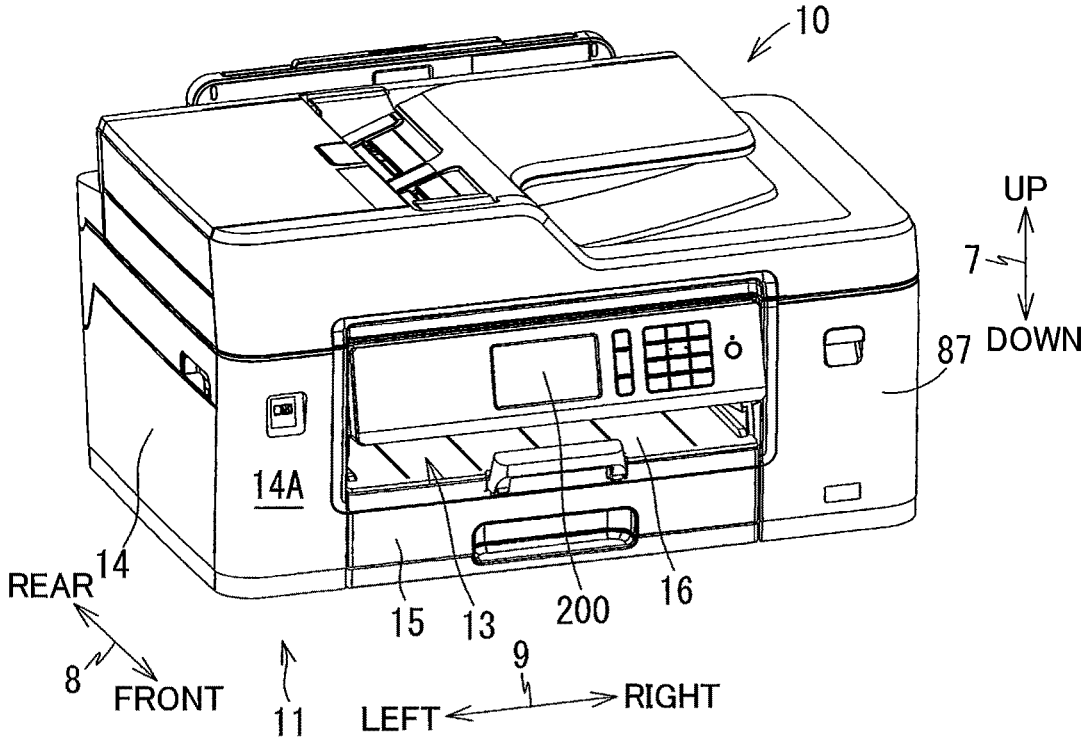
FIG. 1A is a perspective view of a multifunction peripheral according to an embodiment, illustrating a closed position of a cover of the multifunction peripheral.

A multifunction peripheral 10 as an example of an image-recording apparatus according to one embodiment will be described with reference to the accompanying drawings, wherein like parts and components are designated by the same reference numerals to avoid duplicating description.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will also be referred to as an "operable posture". Specifically, an up-down direction 7 of the multifunction peripheral 10 is defined based on the operable posture of the multifunction peripheral 10. A front-rear direction 8 is defined assuming that a surface of the multifunction peripheral 10 formed with an opening 13 is a front surface 14A of the multifunction peripheral 10 in the operable posture. A left-right direction 9 is defined based on an assumption that the multifunction peripheral 10 in the operable posture is viewed from its front surface. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

[Overall Structure of Multifunction Peripheral 10]

Figure 1B:
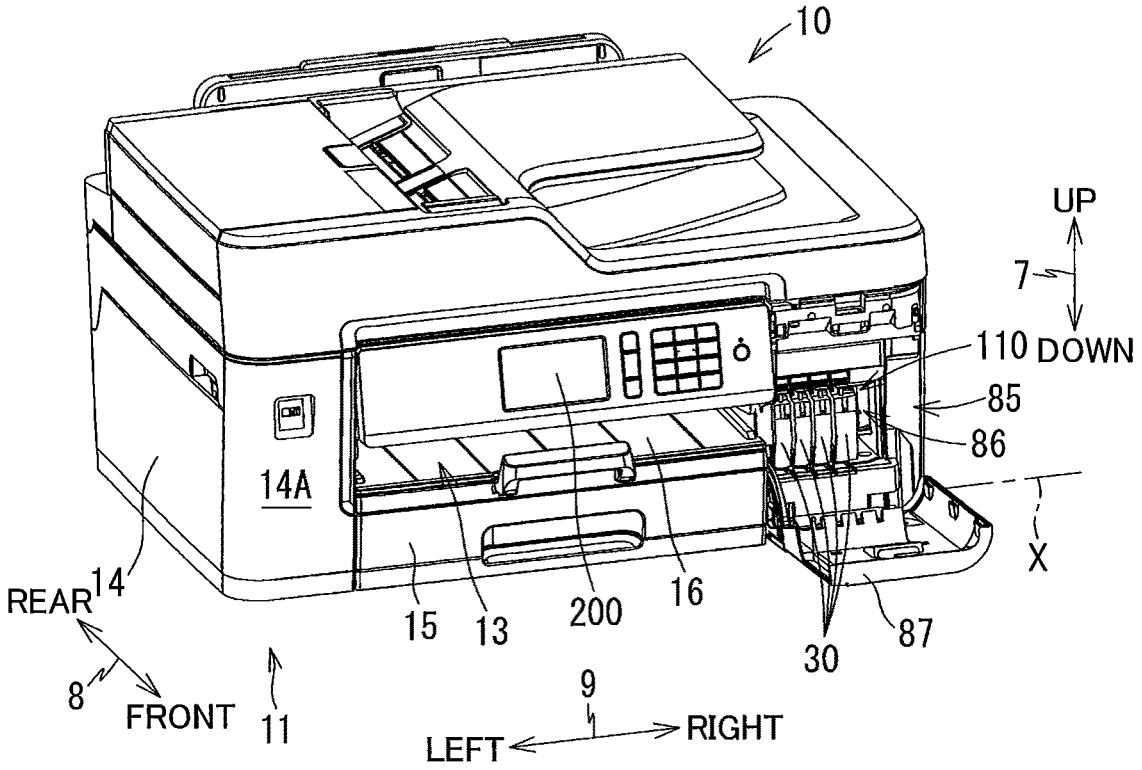
FIG. 1B is a perspective view of the multifunction peripheral according to the embodiment, illustrating an open position of the cover.

As illustrated in FIGS. 1A and 1B, the multifunction peripheral 10 has a substantially rectangular parallelepiped shape. The multifunction peripheral 10 has a lower portion in which a printer portion 11 is provided. The printer portion 11 is configured to record an image on a sheet of paper 12 (see FIG. 2) based on an inkjet recording method. The printer portion 11 includes a casing 14 whose front surface 14A is formed with the opening 13. On the front surface 14A, a display 200 is also provided to display various information thereon.

Figure 2:
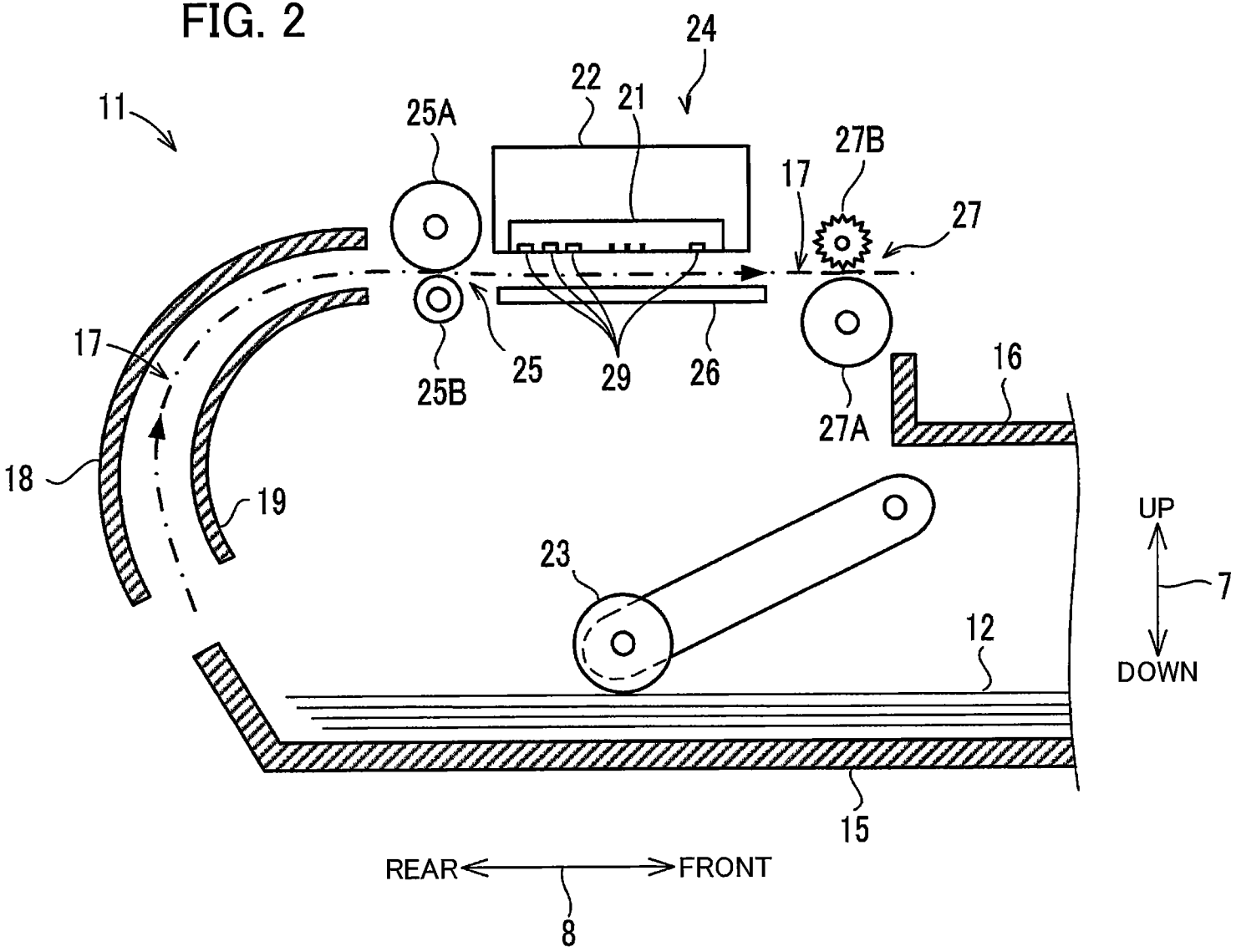
FIG. 2 is a vertical cross-sectional view schematically illustrating an internal configuration of a printer portion of the multifunction peripheral according to the embodiment.

As illustrated in FIG. 2, within the casing 14, a feeding roller 23, a feeding tray 15, a discharge tray 16, a pair of conveying rollers 25, a recording portion 24, a pair of discharging rollers 27, a platen 26, and a cartridge-attachment portion 110 (see FIG. 1B) are disposed. The multifunction peripheral 10 has various functions such as a facsimile function and a printing function.

<Feeding Tray 15, Discharge Tray 16, and Feeding Roller 23>

As illustrated in FIGS. 1A and 1B, the feeding tray 15 is configured to be inserted into and extracted from the casing 14 through the opening 13 in the front-rear direction 8 by a user. The opening 13 is positioned at a center portion of the front surface 14A of the casing 14 in the left-right direction 9. As illustrated in FIG. 2, the feeding tray 15 is configured to support the sheets 12 in a stacked state.

The discharge tray 16 is disposed above the feeding tray 15. The discharge tray 16 is configured to support the sheets 12 discharged by the discharging rollers 27.

The feeding roller 23 is configured to feed each of the sheets 12 supported in the feeding tray 15 onto a conveying path 17. The feeding roller 23 is configured to be driven by a feeding motor 172 (see FIG. 10).

<Conveying Path 17>

As illustrated in FIG. 2, the conveying path 17 is a space partially defined by an outer guide member 18 and an inner guide member 19 opposing each other at a predetermined interval inside the printer portion 11. The conveying path 17 extends rearward from a rear end portion of the feeding tray 15, and then, makes a U-turn frontward while extending upward at a rear portion of the printer portion 11, passes through a space between the recording portion 24 and the platen 26, and reaches the discharge tray 16. A portion of the conveying path 17 positioned between the conveying rollers 25 and the discharging rollers 27 is provided substantially at a center portion of the multifunction peripheral 10 in the left-right direction 9, and extends in the front-rear direction 8. A conveying direction of each sheet 12 in the conveying path 17 is indicated by a dashed-dotted arrow in FIG. 2.

<Conveying Rollers 25>

As illustrated in FIG. 2, the pair of conveying rollers 25 is disposed at the conveying path 17. The conveying rollers 25 include a conveying roller 25A and a pinch roller 25B arranged to oppose each other. The conveying roller 25A is configured to be driven by a conveying motor 171 (see FIG. 10). The pinch roller 25B is configured to be rotated following rotation of the conveying roller 25A. As the conveying roller 25A makes forward rotation in response to forward rotation of the conveying motor 171, each of the sheets 12 is nipped between the conveying roller 25A and the pinch roller 25B to be conveyed in the conveying direction (i.e., frontward direction).

<Discharging Rollers 27>

As illustrated in FIG. 2, the pair of discharging rollers 27 is disposed downstream relative to the pair of conveying rollers 25 in the conveying direction at the conveying path 17. The discharging rollers 27 include a discharging roller 27A and a spur 27B arranged to oppose each other. The discharging roller 27A is configured to be driven by the conveying motor 171 (see FIG. 10). The spur 27B is configured to be rotated following rotation of the discharging roller 27A. As the discharging roller 27A makes forward rotation in response to the forward rotation of the conveying motor 171, each sheet 12 is nipped between the discharging roller 27A and the spur 27B and is conveyed in the conveying direction (i.e., frontward direction).

<Recording Portion 24>

As illustrated in FIG. 2, the recording portion 24 is disposed a position between the conveying rollers 25 and the discharging rollers 27 at the conveying path 17. The recording portion 24 is arranged to oppose the platen 26 in the up-down direction 7, with the conveying path 17 interposed between the recording portion 24 and the platen 26. The recording portion 24 is positioned above the conveying path 17, while the platen 26 is positioned below the conveying path 17. The recording portion 24 includes a carriage 22 and a recording head 21.

Figure 3:
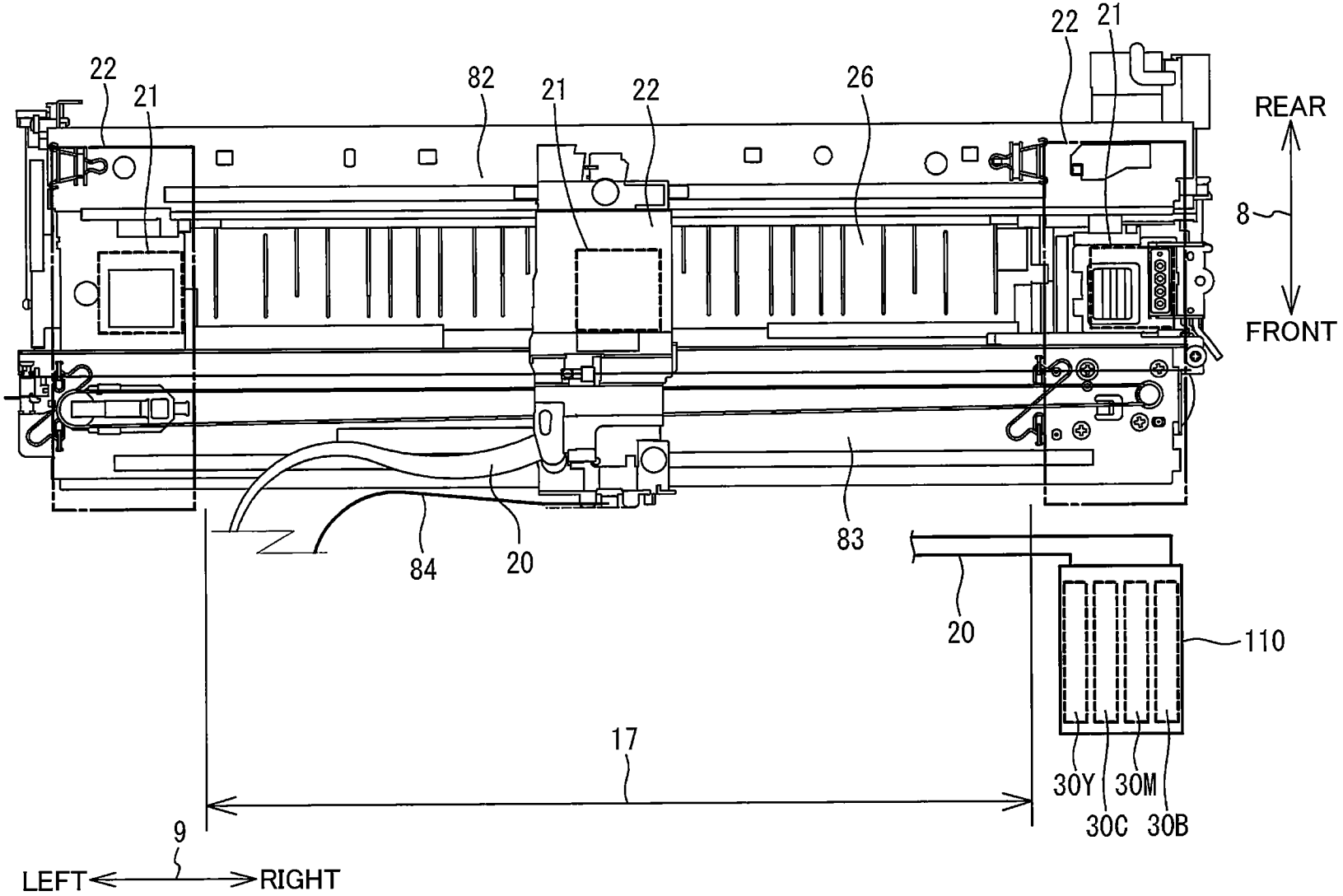
FIG. 3 is a plan view illustrating arrangement of a carriage and a platen relative to a cartridge-attachment portion of the multifunction peripheral according to the embodiment.

As illustrated in FIG. 3, the carriage 22 is supported by guide rails 82 and 83. The guide rails 82 and 83 extend in the left-right direction 9 and are spaced apart from each other in the front-rear direction 8. The guide rails 82 and 83 are supported by a frame (not shown) of the printer portion 11. The carriage 22 is connected to a well-known belt mechanism provided at the guide rail 83. The belt mechanism is driven by a carriage-driving motor 173 (see FIG. 10). The carriage 22 connected to the belt mechanism is configured to make reciprocating movements in the left-right direction 9 in response to driving by the carriage-driving motor 173. The carriage 22 is configured to move within a range from a right side relative to a right end of the conveyance path 17 to a left side relative to a left end of the conveyance path 17, as indicated by alternate long and short dash lines in FIG. 3.

As illustrated in FIG. 3, a bundle of ink tubes 20 and a flexible flat cable 84 extend from the carriage 22.

The ink tubes 20 connect the cartridge-attachment portion 110 (see FIG. 1B) to the recording head 21. Each of the ink tubes 20 is configured to supply ink stored in a corresponding ink cartridge 30 attached to the cartridge-attachment portion 110 to the recording head 21. In the present embodiment, four ink cartridges 30 are configured to be attached to the cartridge-attachment portion 110. Specifically, the four ink cartridges 30 include: an ink cartridge 30B storing black ink, an ink cartridge 30M storing ink of magenta in color, an ink cartridge 30C storing ink of cyan in color, and an ink cartridge 30Y storing ink of yellow in color. These four ink cartridges 30B, 30M, 30C and 30M will be collectively referred to as "ink cartridges 30", hereinafter. Four ink tubes 20 are provided in one-to-one correspondence with the respective ink cartridges 30B, 30M, 30C and 30M so that ink of respective four colors (black, magenta, cyan, and yellow) can flow through the corresponding internal spaces of the ink tubes 20. These four ink tubes 20 are bundled and connected to the recording head 21 mounted on the carriage 22.

The flexible flat cable 84 is configured to establish electrical connection between a controller 130 (see FIG. 10) and the recording head 21. The flexible flat cable 84 is configured to transmit control signals outputted from the controller 130 to the recording head 21.

As illustrated in FIG. 2, the recording head 21 is mounted on the carriage 22. The recording head 21 includes a plurality of nozzles 29 and a plurality of piezoelectric elements 56 (see FIG. 10). The nozzles 29 are arranged at a lower surface of the recording head 21. Ink flow passages are formed in the recording head 21. The piezoelectric elements 56 are configured to deform a portion of the ink flow passages to allow ink droplets to be ejected through the nozzles 29. As will be described later in detail, the piezoelectric elements 56 are configured to operate upon receipt of electric power supplied by the controller 130.

The recording portion 24 is configured to be controlled by the controller 130. As the carriage 22 moves in the left-right direction 9, the recording head 21 ejects ink droplets, through the nozzles 29, toward the conveying path 17, i.e., onto the sheet 12 supported by the platen 26. In this way, an image is recorded on each sheet 12 supported by the platen 26, and the ink stored in each of the ink cartridges 30 is consumed.

<Platen 26>

As illustrated in FIG. 2, the platen 26 is disposed between the conveying rollers 25 and the discharging rollers 27 at the conveying path 17. The platen 26 is arranged to oppose the recording portion 24 in the up-down direction 7, with the conveying path 17 interposed between the platen 26 and the recording portion 24. The platen 26 supports the sheet 12 conveyed by the conveying rollers 25 from below.

<Cover 87>

As illustrated in FIG. 1B, an opening 85 is formed in the front surface 14A of the casing 14 at a right end portion thereof. Rearward of the opening 85, an accommodation space 86 is formed to accommodate the cartridge-attachment portion 110 therein. A cover 87 is assembled to the casing 14 so as to be capable of covering the opening 85. The cover 87 is pivotally movable, about a pivot axis X (pivot center) extending in the left-right direction 9, between a closed position (a position illustrated in FIG. 1A) for closing the opening 85 and an open position (a position illustrated in FIG. 1B) for exposing the opening 85.

<Cartridge-Attachment Portion 110>

As illustrated in FIG. 1B, the cartridge-attachment portion 110 is positioned in a right-front portion on the casing 14. More specifically, as illustrated in FIG. 3, the cartridge-attachment portion 110 is disposed at a position frontward relative to the recording head 21 and rightward relative to the conveying path 17.

As illustrated in FIGS. 4A through 6, the cartridge-attachment portion 110 includes a case 101, contacts 106, rods 125, attachment sensors 113, a lock shaft 145, tanks 103, and liquid-level sensors 55.

The four ink cartridges 30 corresponding to the four colors of ink (cyan, magenta, yellow, and black) are detachably attachable to the cartridge-attachment portion 110. Specifically, the respective ink cartridges 30 are configured to be attached to the case 101 by being moved rearward, and detached from the case 101 by being moved frontward. One set of four contacts 106, one rod 125, one attachment sensor 113, one tank 103, and one liquid-level sensor 55 are provided for each of the four ink cartridges 30. Thus, in the present embodiment, four sets of the four contacts 106, four rods 125, four attachment sensors 113, four tanks 103, and four liquid-level sensors 55 are provided at the cartridge-attachment portion 110. Note that the number of the ink cartridges 30 that can be accommodated in the cartridge-attachment portion 110 is not limited to four, but may be any number.

The four sets of the contacts 106 have the same configurations as one another. The four rods 125 have the same configurations as one another. Likewise, the four attachment sensors 113 have the same configurations as one another. And the four liquid-level sensors 55 have the same configurations as one another. Accordingly, hereinafter, descriptions will be made only about one of the four sets of contacts 106, one of the four rods 125, one of the four attachment sensors 113 and one of the four liquid-level sensors 55, while descriptions for the remaining three of these components will be omitted for simplifying description.

Also note that each of the four tanks 103 is configured to store one of four colors of ink among black, cyan, magenta and yellow. Specifically, hereinafter, a tank 103 storing black ink will be referred to as "tank 103B", a tank 103 storing ink of magenta color will be referred to as "tank 103M", a tank 103 storing ink of cyan color will be referred to as "tank 103C", and a tank 103 storing ink of yellow color will be referred to as "tank 103Y". These four tanks 103B, 103M, 103C and 103Y will be collectively referred to as "tanks 103", hereinafter.

<Case 101>

Figure 4A:
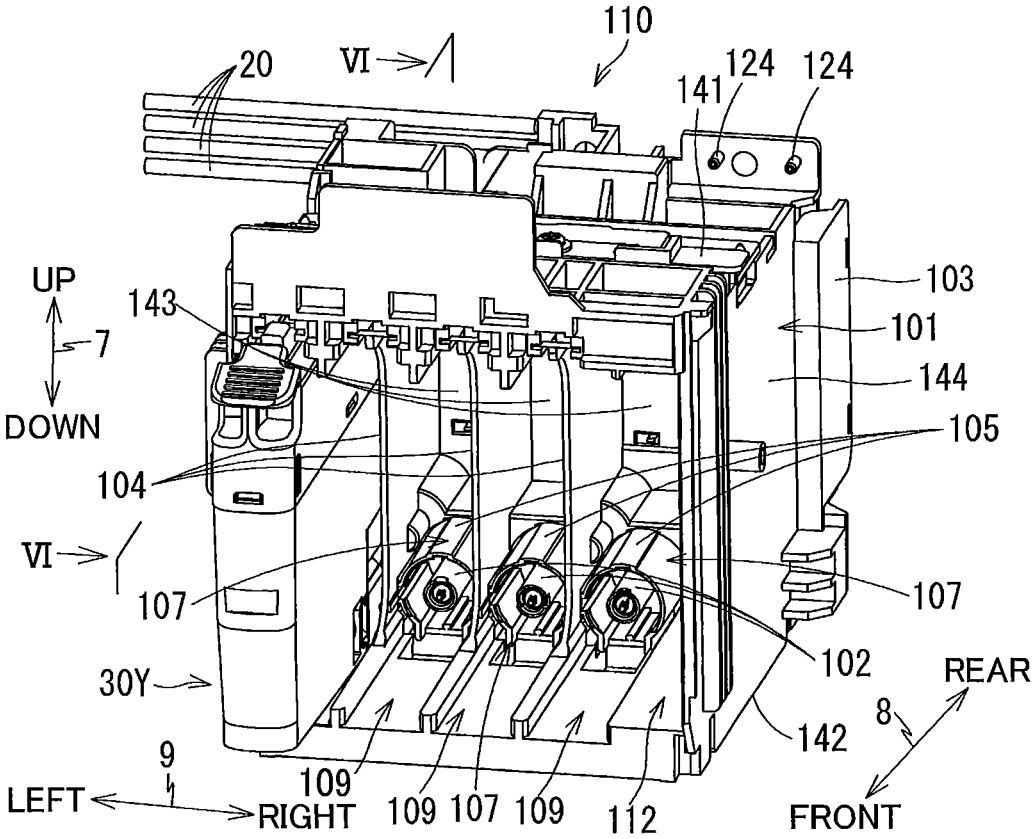
FIG. 4A is a perspective view illustrating an exterior of the cartridge-attachment portion according to the embodiment as viewed from an upper-front side thereof at which an opening is formed, illustrating a state where an ink cartridge 30Y is attached to the cartridge-attachment portion.
Figure 4B:
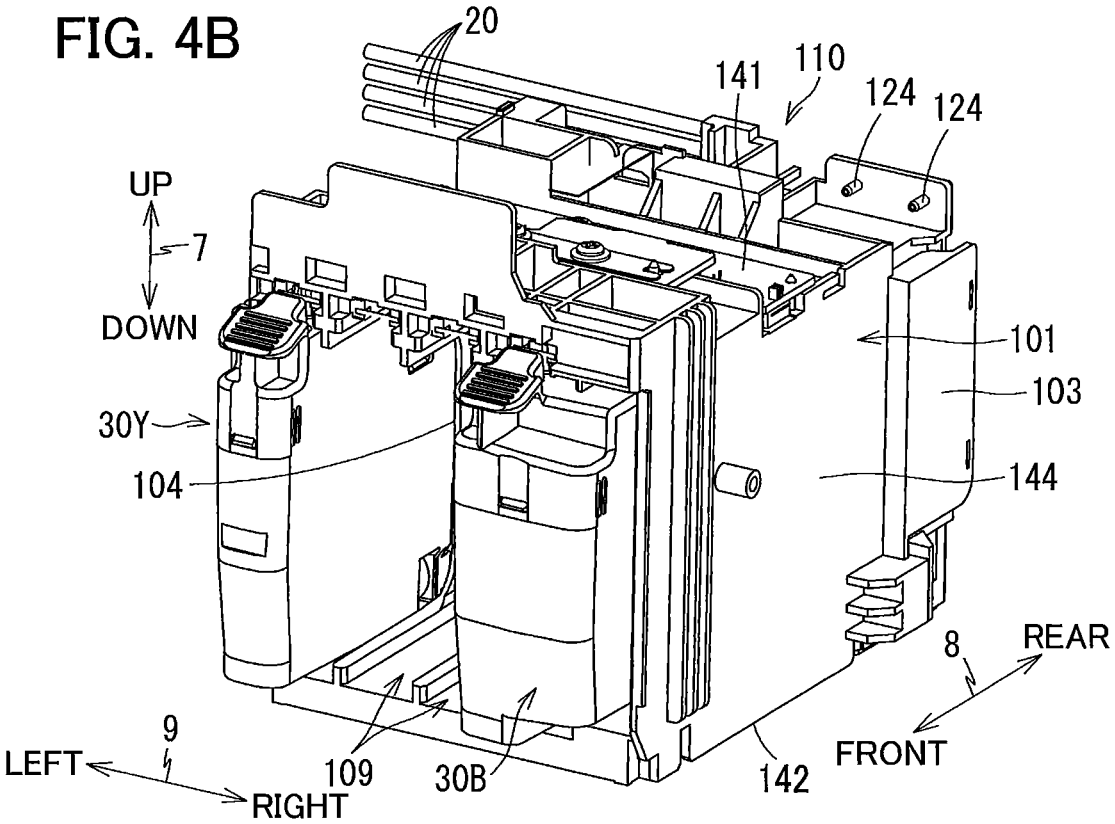
FIG. 4B is a perspective view illustrating the exterior of the cartridge-attachment portion according to the embodiment as viewed from an upper-front and right side thereof, illustrating a state where ink cartridges 30Y and 30B are attached to the cartridge-attachment portion.
Figure 5:
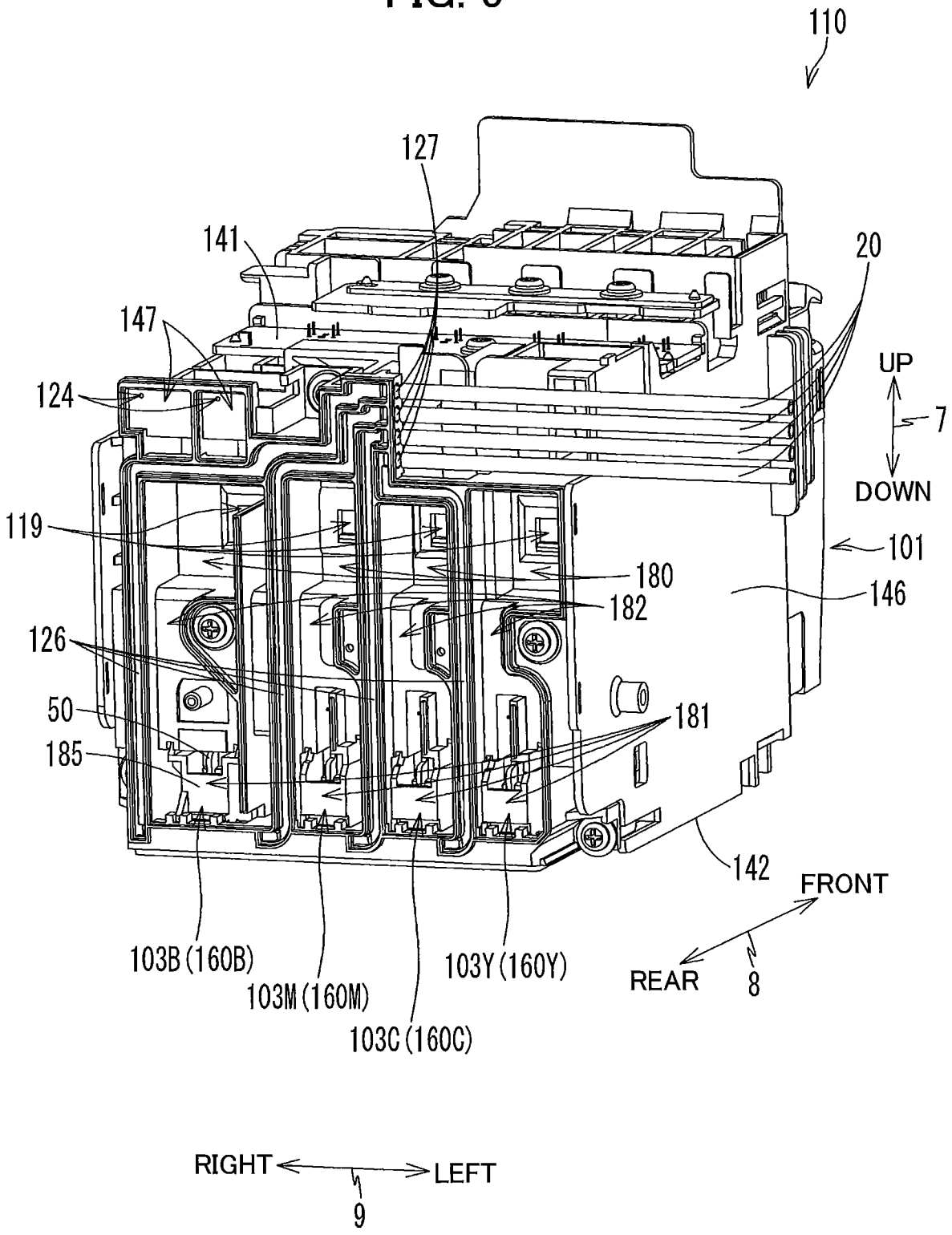
FIG. 5 is a perspective view illustrating the exterior of the cartridge-attachment portion according to the embodiment as viewed from a rear side thereof at which tanks are disposed.
Figure 6:
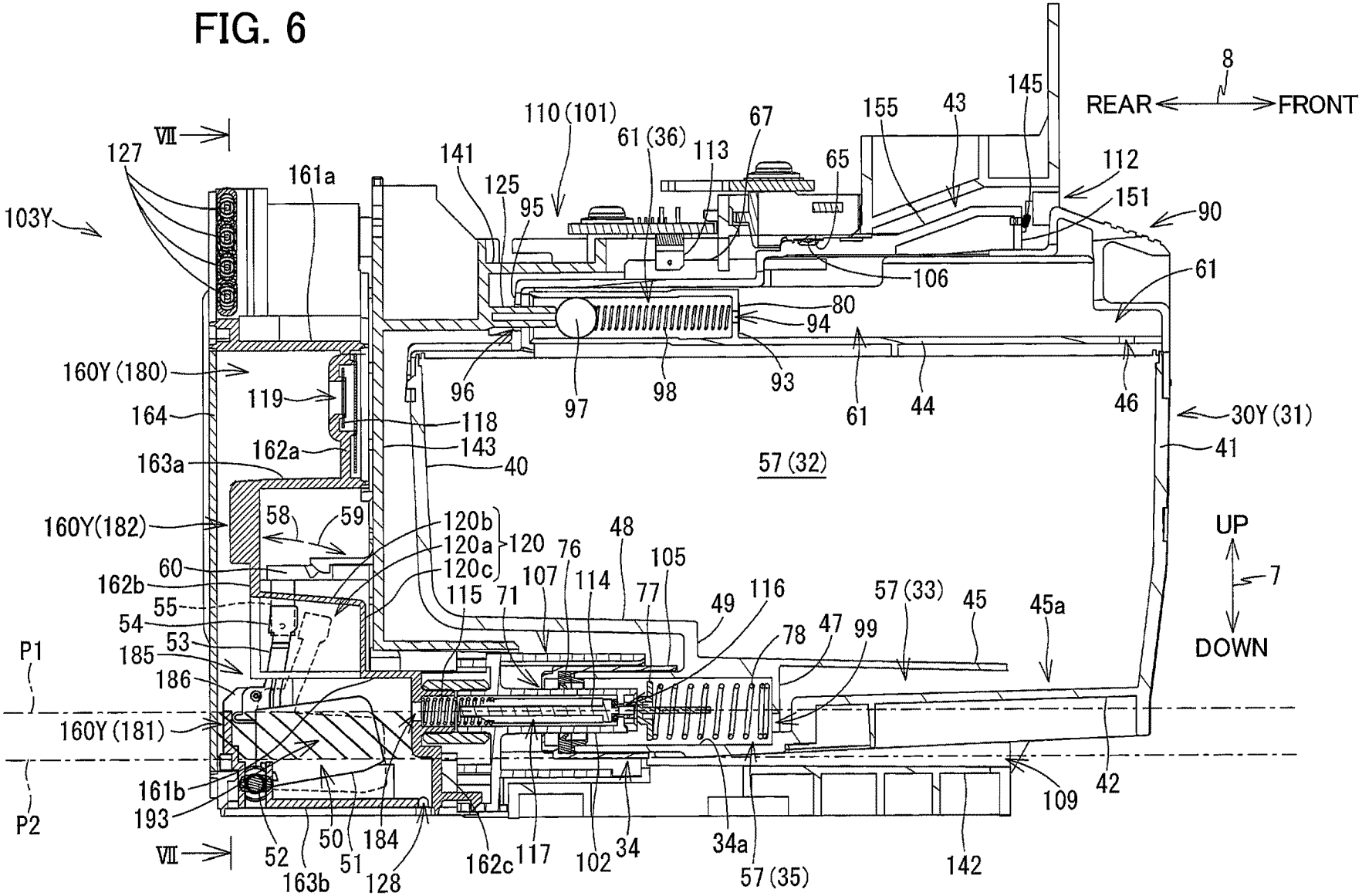
FIG. 6 is a cross-sectional view of the cartridge-attachment portion according to the embodiment to which the ink cartridge 30Y is attached taken along a plane VI-VI shown in FIG. 4A.

As illustrated in FIGS. 4 through 6, the case 101 has a box-like shape defining an internal space therein. Specifically, the case 101 includes: a ceiling wall 141 defining an upper end; a bottom wall 142 defining a bottom end; an end wall 143 defining a rear end in the front-rear direction 8; and a pair of side walls 144 and 146 defining right and left ends in the left-right direction 9. The ceiling wall 141, bottom wall 142, end wall 143 and the pair of side walls 144 and 146 defines the internal space of the case 101. A front end of the case 101, which opposes the end wall 143 in the front-rear direction 8, is formed as an opening 112. The internal space of the case 101 is exposed to the outside through the opening 112. The opening 112 can be exposed to the outside of the multifunction peripheral 10 through the opening 85 of the casing 14 when the cover 87 is at the open position shown in FIG. 1B.

The ink cartridges 30 can be inserted into and extracted from the case 101 through the opening 85 of the casing 14 and the opening 112 of the cartridge-attachment portion 110. In the case 101, the bottom wall 142 is formed with four guide grooves 109 (see FIGS. 4A and 4B) for guiding insertion and extraction of the respective ink cartridges 30 in the front-rear direction 8. Movements of the ink cartridges 30 in the front-rear direction 8 are guided by the corresponding guide grooves 109 as lower end portions of the ink cartridges 30 are inserted into the corresponding guide grooves 109. As illustrated in FIG. 4A, the case 101 is also provided with three plates 104 that partition the internal space of the case 101 into four individual spaces each elongated in the up-down direction 7. Each of the four spaces partitioned by the plates 104 is configured to receive one of the four ink cartridges 30. The ink cartridges 30 accommodated in the respective spaces of the case 101 are juxtaposed with one another in the left-right direction 9.

Note that FIG. 4A illustrates a state where only one of the four ink cartridges 30, i.e., the ink cartridge 30Y, is attached to the cartridge-attachment portion 110. FIG. 4B illustrates a state where two of the ink cartridges 30, i.e., the ink cartridges 30Y and 30B, are attached to the cartridge-attachment portion 110.

<Contacts 106>

As illustrated in FIG. 6, each set of the four contacts 106 is provided on a lower surface of the ceiling wall 141 of the case 101. Each of the four contacts 106 in each set protrudes downward toward the internal space of the case 101 from the lower surface of the ceiling wall 141. Although not illustrated in detail in the drawings, in each set, the four contacts 106 are arranged spaced apart from one another in the left-right direction 9. The four sets of the four contacts 106 are provided each set for each one of the four ink cartridges 30 that can be accommodated in the case 101. The four contacts 106 in each set is arranged each at a position corresponding to one of four electrodes 65 (described later) of the ink cartridge 30. Each contact 106 is made of a material having electrical conductivity and resiliency. The contacts 106 are therefore upwardly resiliently deformable. Note that the number of the contacts 106 and the number of electrodes 65 may be arbitrary.

Each contact 106 is electrically connected to the controller 130 (see FIG. 10) via an electrical circuit. When the contacts 106 are respectively engaged with the corresponding electrodes 65 and electrically connected thereto, a certain voltage is applied to one of the electrodes 65, another one of the electrodes 65 is grounded, and electric power is supplied to still another one of the electrodes 65, for example. Due to establishment of the electrical connection between the contacts 106 and the corresponding electrodes 65, the controller 130 is allowed to access data stored in an IC of the corresponding ink cartridge 30. Outputs from the electrical circuits are configured to be inputted into the controller 130.

<Rod 125>

As illustrated in FIG. 6, each rod 125 is provided at the end wall 143 at a position above a corresponding ink needle 102 (described later). The rod 125 protrudes frontward from the end wall 143 of the case 101. The rod 125 has a cylindrical shape. The rod 125 is configured to be inserted into an air communication port 96 (described later) in a state where the corresponding ink cartridge 30 is attached to the cartridge-attachment portion 110, that is, in a state where the ink cartridge 30 in an attached position.

<Attachment Sensor 113>

As illustrated in FIG. 6, each attachment sensor 113 is also disposed at the lower surface of the ceiling wall 141 of the case 101. The attachment sensor 113 is configured to detect whether or not the ink cartridge 30 is attached to the cartridge-attachment portion 110. The attachment sensor 113 is disposed at a position frontward of the rod 125 but rearward of the contacts 106. In the present embodiment, the attachment sensor 113 includes a light-emitting portion and a light-receiving portion. The light-emitting portion is positioned rightward or leftward relative to the light-receiving portion so as to be spaced apart therefrom in the left-right direction 9. When the ink cartridge 30 has been attached to the cartridge-attachment portion 110, a light-blocking plate 67 (described later) of the attached ink cartridge 30 is disposed between the light-emitting portion and the light-receiving portion of the attachment sensor 113. In other words, the light-emitting portion and the light-receiving portion are arranged to oppose each other, with the light-blocking plate 67 of the attached ink cartridge 30 interposed between the light-emitting portion and the light-receiving portion.

The attachment sensor 113 is configured to output different detection signals depending on whether or not light emitted from the light-emitting portion in the left-right direction 9 is received by the light-receiving portion. For example, the attachment sensor 113 is configured to output a low-level signal to the controller 130 (see FIG. 10) in case that the light-receiving portion does not receive the light emitted from the light-emitting portion (that is, when an intensity of the light received at the light-receiving portion is less than a predetermined intensity). On the other hand, the attachment sensor 113 is configured to output a high-level signal to the controller 130 (see FIG. 10) in case that the light emitted from the light-emitting portion is received by the light-receiving portion (that is, when the intensity of the received light is equal to or greater than the predetermined intensity).

<Lock Shaft 145>

As illustrated in FIG. 6, the lock shaft 145 extends in the left-right direction 9 at a position in the vicinity of the ceiling wall 141 of the case 101 and in the vicinity of the opening 112. The lock shaft 145 is a bar-like member extending in the left-right direction 9. The lock shaft 145 is, for example, a metal column. The lock shaft 145 has a left end fixed to the side wall 146 of the case 101, and a right end fixed to the side wall 144 of the case 101. The lock shaft 145 extends in the left-right direction 9 over the four spaces of the case 101 in which the four ink cartridges 30 can be respectively accommodated.

The lock shaft 145 is configured to hold each of the ink cartridges 30 attached to the cartridge-attachment portion 110 at the attached position. The ink cartridges 30 are respectively engaged with the lock shaft 145 in a state where the ink cartridges 30 are attached to the cartridge-attachment portion 110. The lock shaft 145 is configured to retain each ink cartridge 30 against urging forces of coil springs 78 and 98 of the ink cartridge 30 that push the ink cartridge 30 frontward.

<Tanks 103>

Figure 7:
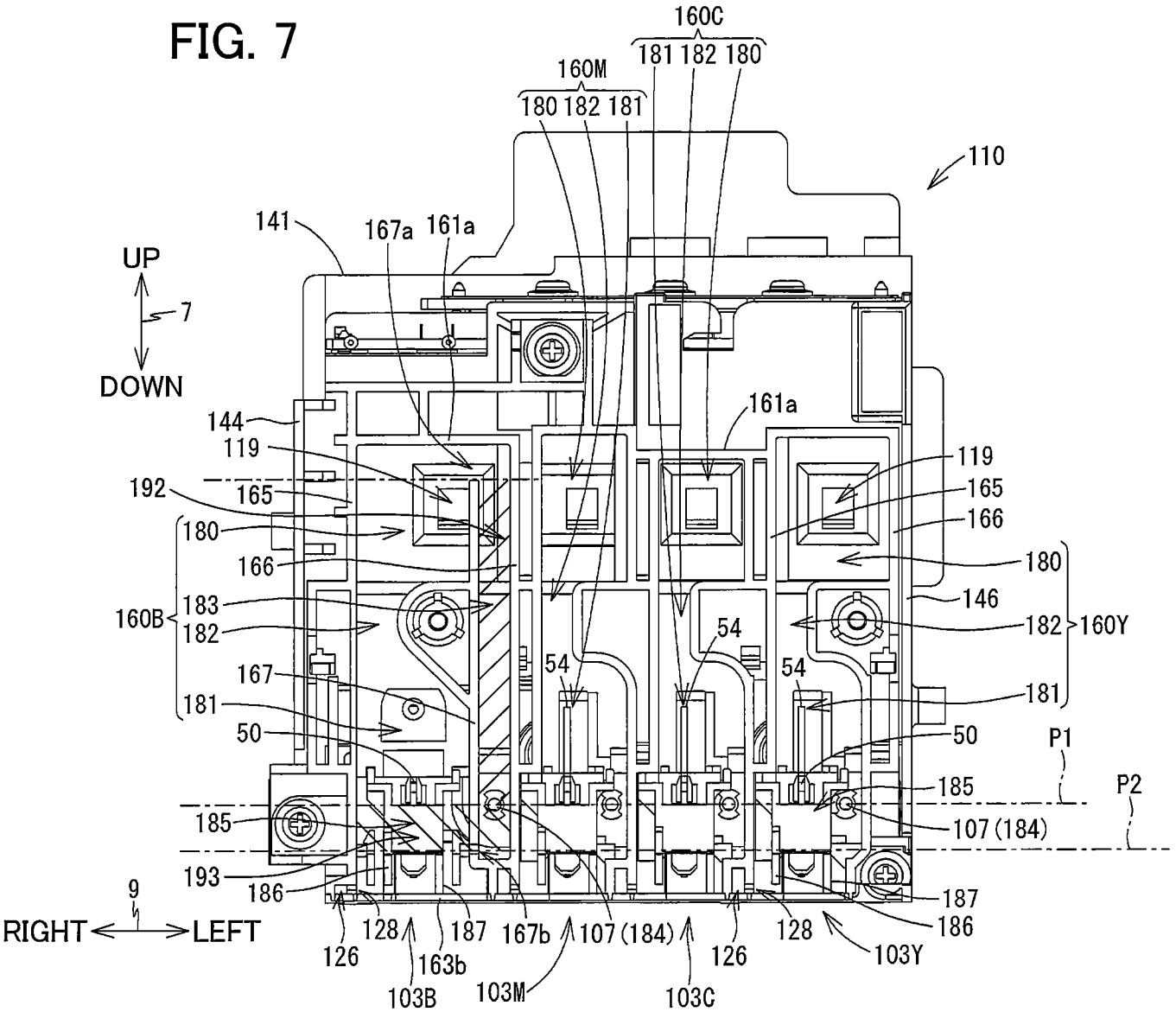
FIG. 7 is a cross-sectional view of the cartridge-attachment portion according to the embodiment taken along a plane VII-VII shown in FIG. 6.

As illustrated in FIGS. 5 and 7, the case 101 includes four tanks 103B, 103M, 103C and 103Y. These four tanks 103B, 103M, 103C and 103Y are arranged to be aligned with one another in the left-right direction 9. The four tanks 103B, 103M, 103C and 103Y correspond to the ink cartridges 30B, 30M, 30C and 30Y, respectively. That is, ink stored in the ink cartridges 30B, 30M, 30C and 30Y is configured to flow into the tanks 103B, 103M, 103C and 103Y, respectively.

As illustrated in FIG. 6, the respective tanks 103 are positioned rearward relative to the corresponding end walls 143 of the case 101. As shown in FIG. 5, each of the tanks 103B, 103M, 103C and 103Y has a generally box shape.

Specifically, as illustrated in FIGS. 5 through 7, each of the tanks 103B, 103M, 103C and 103Y includes a box-shaped tank main body and a connecting portion 107.

As illustrated in FIGS. 5 to 7, each tank main body defines a storage chamber 160 therein.

Specifically, as illustrated in FIGS. 6 and 7, each tank main body includes a first upper wall 161*a*, a second upper wall 161*b*, a first front wall 162*a*, a second front wall 162*b*, a third front wall 162*c*, a first lower wall 163*a*, a second lower wall 163*b*, a rear wall 164, a pair of side walls 165 and 166, and a projecting portion 120 defined by an upper wall 120*b* and a front wall 120*c*.

As illustrated in FIG. 6, the first upper wall 161*a* is positioned upward relative to the second upper wall 161*b*.

The first front wall 162*a* is positioned frontward relative to the second front wall 162*b*. The third front wall 162*c* is positioned frontward relative to the first front wall 162*a*.

The first lower wall 163*a* is positioned upward relative to the second lower wall 163*b*.

The first front wall 162*a* extends downward from a front end of the first upper wall 161*a*. The first lower wall 163*a* extends rearward from a lower end of the first front wall 162*a*. The second front wall 162*b* extends downward from a rear end of the first lower wall 163*a*. The upper wall 120*b* extends frontward from a lower end of the second front wall 162*b*. The front wall 120*c* extends downward from a front end of the upper wall 120*b*. The second upper wall 161*b* extends frontward from a lower end of the upper wall 120*b*. The third front wall 162*c* extends downward from a front end of the second upper wall 161*b*. The second lower wall 163*b* extends rearward from a lower end of the third front wall 162*c*.

As illustrated in FIG. 7, the side wall 165 is connected to respective right ends of the upper walls (first and second upper walls 161*a* and 161*b*), front walls (first to third front walls 162*a*, 162*b*, and 162*c*), and lower walls (first and second lower walls 163*a* and 163*b*) of the corresponding tank 103 (one of the tanks 103B, 103M, 103C and 103Y). Similarly, the side wall 166 is connected to respective left ends of the upper walls (first and second upper walls 161*a* and 161*b*), front walls (first to third front walls 162*a*, 162*b*, and 162*c*), and lower walls (first and second lower walls 163*a* and 163*b*) of the corresponding tank 103 (one of the tanks 103B, 103M, 103C and 103Y).

The rear wall 164 is a film welded to rear end surfaces of the first upper wall 161*a*, second lower wall 163*b*, side wall 165 and side wall 166. In FIG. 5, the rear wall 164 (film) is not illustrated. Note that, while the rear wall 164 is a film in the present embodiment, the walls other than the rear wall 164 may be a film. Alternatively, the rear wall 164 may be a resin wall, instead of a film.

As illustrated in FIG. 6, the connecting portion 107 is adapted to be connected to an ink supply portion 34 of the corresponding ink cartridge 30 attached to the cartridge-attachment portion 110. Upon connection to the ink supply portion 34, the connecting portion 107 is allowed to communicate with a storage chamber 57 storing ink in the ink cartridge 30. The ink stored in the ink cartridge 30 is thus allowed to flow into the storage chamber 160 through the connecting portion 107. That is, the storage chamber 160 is configured to accommodate ink supplied from the ink supply portion 34 connected to the connecting portion 107. Detailed structures of the connecting portion 107 and storage chamber 160 will be described later.

<Connecting Portion 107>

The connecting portion 107 is disposed at each tank 103. Since the connecting portions 107 have the same structures as one another, only one of the connecting portions 107 will be described in detail hereinafter, while descriptions for the remaining three connecting portions 107 will be omitted.

As illustrated in FIG. 4A, the connecting portion 107 includes the ink needle 102 having a hollow configuration, and a guide portion 105.

The ink needle 102 is made of resin and has a generally tubular shape. The ink needle 102 is disposed at a lower end portion of the corresponding end wall 143 of the case 101. Specifically, the ink needle 102 is disposed on the end wall 143 of the case 101 at a position corresponding to the ink supply portion 34 of the ink cartridge 30 attached to the cartridge-attachment portion 110. The ink needle 102 protrudes frontward from the end wall 143 of the case 101.

The guide portion 105 has a cylindrical shape, and is disposed at the end wall 143 to surround the ink needle 102. The guide portion 105 protrudes frontward from the end wall 143 of the case 101. A protruding end (front end) of the guide portion 105 is open. Specifically, the ink needle 102 is positioned at a diametrical center of the guide portion 105.

The guide portion 105 is so shaped that the ink supply portion 34 of the attached ink cartridge 30 is received in the guide portion 105.

The connecting portion 107 is not connected to the ink supply portion 34 of the ink cartridge 30 in a state where the ink cartridge 30 is not attached to the cartridge-attachment portion 110. During an insertion process of the ink cartridge 30 into the cartridge-attachment portion 110, i.e., in the course of action for bringing the ink cartridge 30 into an attached position in the cartridge-attachment portion 110 (i.e., a position illustrated in FIG. 6), the ink supply portion 34 of the ink cartridge 30 enters into the guide portion 105. As the ink cartridge 30 is further inserted rearward into the cartridge-attachment portion 110, the ink needle 102 enters into an ink supply port 71 formed in the ink supply portion 34 (see FIG. 6). As a result, the connecting portion 107 is connected to the ink supply portion 34. Hence, ink stored in a storage chamber 33 formed in the ink cartridge 30 is allowed to flow into the corresponding tank 103 through an ink valve chamber 35 formed in the ink supply portion 34 and an internal space 117 defined in the ink needle 102.

Incidentally, the ink needle 102 may have a flat-shaped tip end or a pointed tip end.

As illustrated in FIG. 6, a valve 114 and a coil spring 115 are accommodated in the internal space 117 of the ink needle 102. The valve 114 is movable in the front-rear direction 8 to open and close an opening 116 formed in a protruding tip end portion of the ink needle 102. That is, the valve 114 is configured to open and close the internal space 117 of the ink needle 102. The coil spring 115 urges the valve 114 frontward. Accordingly, the valve 114 closes off the opening 116 in a state where no external force is applied to the valve 114 (i.e., in a state where the ink cartridge 30 is not attached to the cartridge-attachment portion 110). Further, a front end portion of the valve 114 urged by the coil spring 115 protrudes frontward relative to the opening 116 in a state where no external force is applied to the valve 114. In the process of connecting the connecting portion 107 to the ink supply portion 34, the valve 114 opens the opening 116. Details on how the valve 114 opens the opening 116 will be described later.

<Overall Structure of the Storage Chambers 160>

In the present embodiment, the multifunction peripheral 10 includes four storage chambers 160 (160B, 160M, 160C and 160Y) corresponding to the tanks 103C, 103M, 103C and 103Y, respectively.

In the following description, the storage chamber 160 provided in the tank 103B, that is, the storage chamber 160 configured to store black ink, will be referred to as the storage chamber 160B; the storage chamber 160 provided in the tank 103M, that is, the storage chamber 160 configured to store ink of magenta color, will be referred to as the storage chamber 160M; the storage chamber 160 provided in the tank 103C, that is, the storage chamber 160 configured to store ink of cyan color, will be referred to as the storage chamber 160C; and the storage chamber 160 provided in the tank 103Y, that is, the storage chamber 160 configured to store yellow ink, will be referred to as the storage chamber 160Y. Also, the four storage chambers 160B, 160M, 160C and 160Y will be collectively referred to as "storage chambers 160".

The storage chambers 160M, 160C and 160Y have generally the same structures as one another, while the storage chamber 160B has a different structure from the storage chambers 160M, 160C and 160Y. Hence, hereinafter, the structures of the storage chambers 160M, 160C and 160Y will be described first, and the structure of the storage chamber 160B will be described subsequently.

Note that differences in structure among the four storage chambers 160B, 160M, 160C and 160Y may not be limited to those in the present embodiment. For example, the storage chambers 160M, 160C and 160Y may have the same structure as the storage chamber 160B. Alternatively, the storage chamber 160B may have the same structure as the storage chambers 160M, 160C and 160Y. Still alternatively, the storage chamber 160M may have the same structure as the storage chamber 160B, while the storage chambers 160C and 160Y may have a different structure from the storage chamber 160B.

<Storage Chambers 160M, 160C, 160Y>

Since the storage chambers 160M, 160C and 160Y have generally the same structures as one another, hereinafter, the structure of the storage chamber 160Y will be described in detail as an illustrative example while referring to the storage chambers 160M and 160C wherever necessary.

As illustrated in FIGS. 5 through 7, the storage chamber 160Y includes a buffer chamber 180, a first chamber 181 and a second chamber 182.

The buffer chamber 180 is defined by the first upper wall 161*a*, the first front wall 162*a*, the first lower wall 163*a*, the rear wall 164, the side wall 165 and the side wall 166.

The first chamber 181 is defined by the second upper wall 161*b*, the third front wall 162*c*, the second lower wall 163*b*, the rear wall 164, the side wall 165 and the side wall 166.

The second chamber 182 is defined by the second front wall 162*b*, the rear wall 164, and the side wall 165 and the side wall 166.

Referring to FIG. 7, with regard to the storage chamber 160Y, right ends of the buffer chamber 180 and second chamber 182 are defined by the side wall 165 constituting the storage chamber 160Y. However, only a lower-right end portion of the first chamber 181 is defined by the side wall 166 defining the left end of the storage chamber 160C positioned to the right of the storage chamber 160Y, while a remaining portion of the right end of the first chamber 181 is defined by the side wall 165.

Specifically, the buffer chamber 180 is positioned above the second chamber 182. The first chamber 181 is positioned below the second chamber 182. An upper end of the second chamber 182 is in communication with the buffer chamber 180. A lower end of the second chamber 182 is in communication with the first chamber 181. That is, the buffer chamber 180 and first chamber 181 are in communication with each other through the second chamber 182.

Referring to FIG. 7, the upper end of the second chamber 182 is in communication with a right end portion of the buffer chamber 180. The lower end of the second chamber 182 is in communication with a right end portion of the first chamber 181.

Further, referring to FIG. 6, the upper end of the second chamber 182 is in communication with a rear end portion of the buffer chamber 180. The lower end of the second chamber 182 is in communication with a rear end portion of the first chamber 181.

The projecting portion 120 is provided above the first chamber 181 and frontward of the second chamber 182. The projecting portion 120 is defined by the upper wall 120*b* and the front wall 120*c*. The projecting portion 120 also includes side walls facing rightward and leftward that are made of material capable of transmitting light. The projecting portion 120 defines therein an internal space 120*a* that is in communication with the first chamber 181 and second chamber 182. The internal space 120*a* of the projecting portion 120 constitutes a portion of the storage chamber 160Y. Within this internal space 120*a* of the projecting portion 120, an arm 53 and a detected portion 54 of a pivoting member 50 (described later) are disposed. Note that the projecting portion 120 may be configured to communicate with one of the first chamber 181 and second chamber 182, rather than both of the first chamber 181 and second chamber 182.

In the third front wall 162*c*, a communication port 184 is formed. The communication port 184 communicates with the first chamber 181. The first chamber 181 is in communication with the internal space 117 of the ink needle 102 via the communication port 184. This structure allows the ink flowing out of the ink cartridge 30Y through the ink needle 102 to flow into the storage chamber 160Y and to be stored therein.

In a state where a liquid level of the ink stored in the storage chamber 160Y is at the same height as the communication port 184 in the up-down direction 7, the buffer chamber 180 is positioned higher than the liquid level of the ink stored in the storage chamber 160Y. In the present embodiment, "the liquid level of the ink stored in the storage chamber 160Y is at the same height as the communication port 184" denotes a state where the liquid surface is positioned at the same height as an axial center of the ink needle 102 (i.e., a center of the communication port 184) in the up-down direction 7, i.e., at the same height as the center of the ink supply port 71 in the up-down direction 7. More specifically, in the present embodiment, the liquid surface is deemed to be "at the same height as the communication port 184" when the liquid surface is at a position P1 indicated by a chain line in FIG. 6.

Incidentally, the liquid surface may not necessarily be at the position P1 in order to be deemed at the same height as the communication port 184. For example, the liquid surface may be considered to be at the same height as the communication port 184 when the liquid surface is at the same height as an upper edge or lower edge of the communication port 184 in the up-down direction 7.

As shown in FIG. 7, the storage chamber 160Y is in communication with a corresponding ink passage 126 via a communication port 128. In the present embodiment, the first chamber 181 communicates with the ink passage 126 through the communication port 128. The communication port 128 is formed in a lower end portion of the side wall 165 that defines the lower-right end portion of the first chamber 181 of the storage chamber 160Y.

Referring to FIG. 6, the communication port 128 is positioned lower than the communication port 184 communicating with the connecting portion 107.

Further, referring to FIG. 6, the communication port 128 is formed to communicate with a front end portion of the first chamber 181. Specifically, the communication port 128 is formed in a front end portion of the side wall 165.

Referring to FIG. 5, each ink passage 126 extends upward from a rear end of each tank 103 and is connected to an ink outlet port 127. Each ink outlet port 127 is connected to corresponding one of the ink tubes 20. With this structure, the ink stored in the storage chamber 160Y is allowed to flow into the ink passage 126 through the communication port 128, and to be supplied to the recording head 21 through the corresponding ink passage 126 and ink tube 20.

The buffer chamber 180 is in communication with corresponding one of two air communication ports 124 (see FIG. 4) disposed upward of the tanks 103. The buffer chamber 180 is in communication with the corresponding air communication port 124 through a through-hole 119 (see FIG. 6) formed in the first front wall 162*a*. The through-hole 119 is sealed with a semi-permeable membrane 118. An air flow path 147 (see FIG. 5) connects the through-hole 119 of the storage chamber 160Y to the corresponding air communication port 124. The air communication port 124 is configured to be open to the outside so that the storage chamber 160Y is opened to the atmosphere. In other words, the air communication port 124 allows the storage chamber 160Y to communicate with the atmosphere. Note that the air communication port 124 is configured to allow the storage chamber 160Y to communicate with the atmosphere via a different route from that provided by the air communication port 96 of the ink cartridge 30Y.

In the present embodiment, two air flow paths 147 are provided. One of the two air flow paths 147 connects the through-hole 119 of the storage chamber 160B to one of the two air communication ports 124. The other air flow path 147 connects the respective through-holes 119 of the storage chambers 160M, 160C and 160Y to the other one of the air communication ports 124.

Incidentally, the air flow paths 147 may have different structures from that of the embodiment. For example, only one air flow path 147 may be provided, instead of two, such that the sole air flow path 147 may connect each of the through-holes 119 of the storage chambers 160 to a single air communication port 124.

<Storage Chamber 160B>

Next, a detailed structure of the storage chamber 160B will be described. In the following description, those parts and components common to those of the storage chambers 160M, 160C and 160Y will be not described to avoid duplicating description.

As illustrated in FIGS. 5 and 7, an inner wall 167 is provided in the storage chamber 160B. The inner wall 167 is a wall extending in the up-down direction 7 and left-right direction 9. The inner wall 167 is disposed between the side walls 165 and 166 in the left-right direction 9. The inner wall 167 has a front end connected to the front walls (first front wall 162*a*, second front wall 162*b* and third front wall 162*c*). The inner wall 167 has a rear end connected to the rear wall 164. That is, the rear wall 164 (film) is welded to a rear end surface of the inner wall 167.

Note that, while the inner wall 167 of the embodiment extends vertically upward in the up-down direction 7, the inner wall 167 does not necessarily extend vertically. For example, the inner wall 167 may extend in a direction slanted relative to the up-down direction 7.

The storage chamber 160B includes a third chamber 183, in addition to the three chambers (buffer chamber 180, the first chamber 181 and the second chamber 182) that are also defined in each of the storage chambers 160M, 160C and 160Y. In other words, the storage chamber 160B includes the buffer chamber 180, the first chamber 181, the second chamber 182 and the third chamber 183.

Specifically, the second chamber 182 of the storage chamber 160B is defined by the second front wall 162*b*, the rear wall 164, the side wall 165 and the inner wall 167.

The third chamber 183 is defined by the second front wall 162*b*, the rear wall 164, the inner wall 167 and the side wall 166. The third chamber 183 is positioned below the buffer chamber 180 and upward of the first chamber 181. An upper end of the third chamber 183 is in communication with the buffer chamber 180. A lower end of the third chamber 183 is in communication with the first chamber 181.

Specifically, the upper end of the third chamber 183 communicates with a rear end portion of the buffer chamber 180. The lower end of the third chamber 183 communicates with a rear end portion of the first chamber 181. Further, as illustrated in FIG. 7, the upper end of the third chamber 183 is in communication with a left end portion of the buffer chamber 180, while the lower end of the third chamber 183 is in communication with a left end portion of the first chamber 181.

The third chamber 183 is disposed leftward of the second chamber 182. The third chamber 183 is separated from the second chamber 182 by the inner wall 167. That is, the third chamber 183 and the second chamber 182 do not communicate with each other. Put another way, the third chamber 183 connects the buffer chamber 180 to the first chamber 181 at a position leftward of the second chamber 182.

That is, the inner wall 167 partitions an internal space of the storage chamber 160B in the left-right direction 9. In the storage chamber 160B, the pivoting member 50 (described later) is disposed rightward of the inner wall 167. The storage chamber 160B is connected to the connecting portion 107 via the communication port 184 at a position leftward of the inner wall 167. That is, the inner wall 167 partitions a space between the connecting portion 107 and the pivoting member 50 in the left-right direction 9 within the storage chamber 160B.

The inner wall 167 extends to span between upper and lower portions of the storage chamber 160B. That is, the inner wall 167 spans between the buffer chamber 180 and the first chamber 181 in the up-down direction 7. With the inner wall 167, the buffer chamber 180 is divided into two spaces in the left-right direction 9, and the first chamber 181 is also divided into two spaces in the left-right direction 9.

Figure 12B:
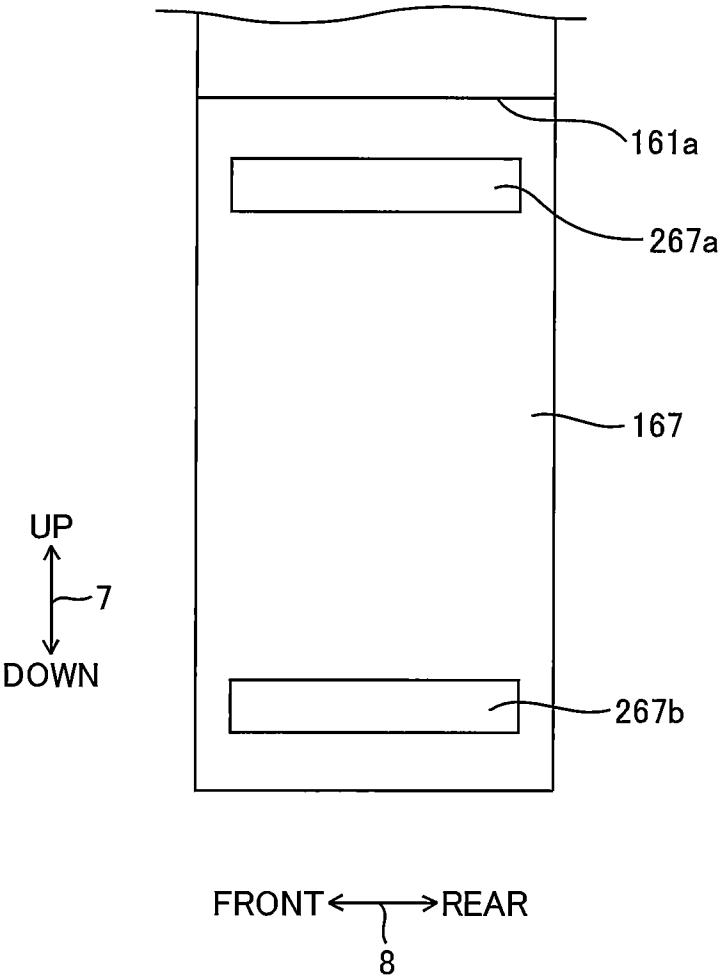
FIG. 12B is a schematic side view of an inner wall according to a variation of the embodiment.
Figure 12A:
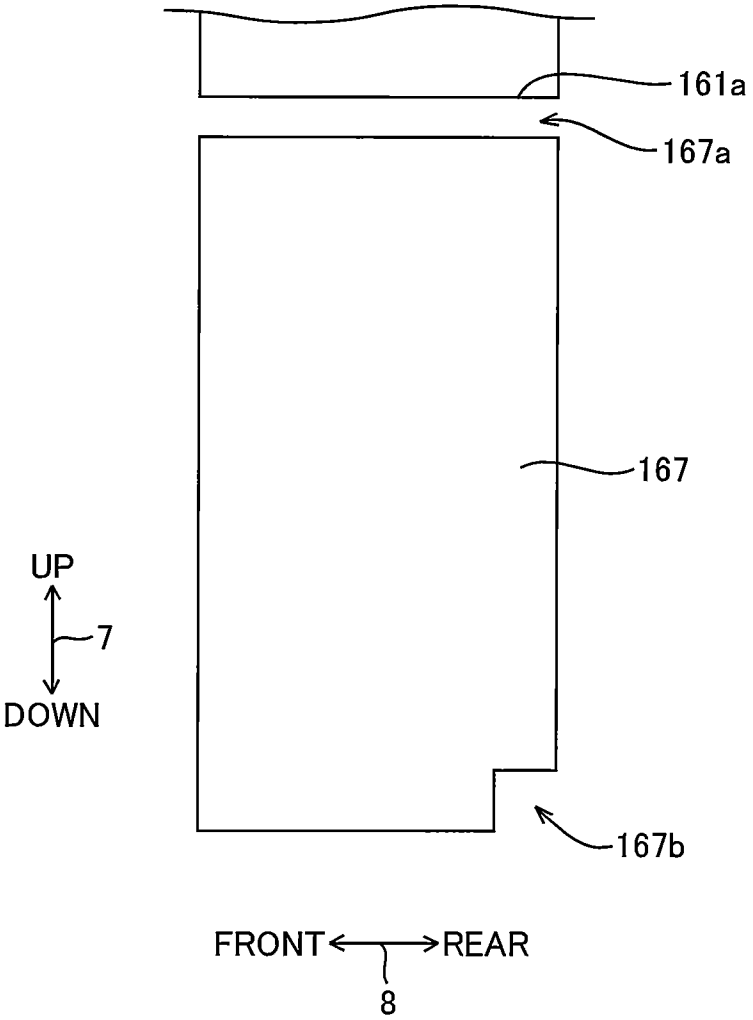
FIG. 12A is a schematic side view of an inner wall provided in a storage chamber 160B of a tank for black ink of the cartridge-attachment portion according to the embodiment.

The inner wall 167 has an upper end that defines a gap 167*a* with the first upper wall 161*a* (see FIGS. 7 and 12A). The two spaces in the buffer chamber 180 separated by the inner wall 167 are allowed to communicate with each other through the gap 167*a*. Likewise, the inner wall 167 has a lower end portion that is formed with a notch 167*b* (see FIGS. 7 and 12A). The two spaces in the first chamber 181 separated by the inner wall 167 are allowed to communicate with each other through the notch 167*b*.

Incidentally, the inner wall 167 does not necessarily extend to span between the upper and lower end portions of the storage chamber 160B, provided that the inner wall 167 spans from a position upward relative to the communication port 184 and the detected portion 54 to a position downward relative to the communication port 184 and the detected portion 54. For example, the upper end of the inner wall 167 may extend up to a position lower than the position shown in FIG. 7. Still alternatively, the inner wall 167 may extend upward to be connected to the first upper wall 161*a* of the storage chamber 160B. In this case, as illustrated in FIG. 12B, an upper end portion of the inner wall 167 may be formed with a through-hole 267*a* to allow communication between the two spaces in the buffer chamber 180.

As illustrated in FIG. 7, the communication port 128 of the storage chamber 160B is formed at a position rightward relative to the inner wall 167 and downward relative to the notch 167*b* in the present embodiment. Alternatively, the communication port 128 may be provided leftward relative to the inner wall 167 in the storage chamber 160B. Still alternatively, the communication port 128 may be provided at the same height as the notch 167*b* in the up-down direction 7. Still alternatively, the communication port 128 may be provided upward relative to the notch 167*b*.

Incidentally, referring to FIG. 12B, the lower end portion of the inner wall 167 may be formed with a through-hole 267*b*, instead of the notch 167*b*, so as to allow communication between the two spaces in the first chamber 181.

As described above, the inner wall 167 partitions the internal space of the storage chamber 160B in the left-right direction 9. That is, the inner wall 167 partitions the space between the connecting portion 107 and the pivoting member 50 in the left-right direction 9 within the storage chamber 160B. Here, referring to FIG. 7, a space positioned leftward relative to the inner wall 167 will be referred to as a space 192, hereinafter. This space 192 is a region shown with upper-left to lower-right hatching in FIG. 7. The communication port 184 in communication with the connecting portion 107 is disposed in the space 192. On the other hand, the pivoting member 50 is disposed in a space positioned rightward relative to the inner wall 167.

In the up-down direction 7, the space 192 is positioned upward relative to the communication port 184 of the connecting portion 107 (i.e., position P1 in the embodiment) and lower than the upper end of the inner wall 167. That is, the space 192 is a space positioned leftward of the inner wall 167 in the left-right direction 9 and spanning between the upper end of the inner wall 167 and the position P1 in the up-down direction 7. The space 192 has a larger volume than a space 193 shown with upper-right to lower-left hatching in FIG. 7.

The space 193 is a space positioned lower than the communication port 184 of the connecting portion 107 (i.e., position P1) and upward relative to the position P2 in the up-down direction 7. That is, the space 193 is a space positioned between the position P1 and position P2 in the up-down direction 7. The space 193 is also shown as a hatched region in FIG. 6.

<Pivoting Member 50>

As illustrated in FIG. 6, the pivoting member 50 is disposed in the storage chamber 160 of each tank 103. The pivoting member 50 is supported by a support member 185 disposed in each storage chamber 160 so as to be pivotally movable in directions of arrows 58 and 59. The pivoting member 50 may be supported by a structure other than the support member 185. For example, the pivoting member 50 may be supported by walls of the case 101 that define the storage chamber 160.

As illustrated in FIG. 6, the pivoting member 50 includes a float 51, a shaft 52, the arm 53, and the detected portion 54.

The float 51 constitutes a lower portion of the pivoting member 50. The float 51 is made of a material having a specific gravity smaller than a specific gravity of the ink stored in the storage chamber 160. The shaft 52 protrudes from left and right surfaces of the float 51 in the left-right direction 9. Protruding ends of the shaft 52 are inserted into holes each formed in one of right and left side walls 186 and 187 constituting the support member 185 (see FIGS. 6 and 7). With this configuration, the pivoting member 50 is supported by the support member 185 so as to be pivotally movable about an axis of the shaft 52. The shaft 52 is positioned downward relative to the communication port 184 of the corresponding connecting portion 107 (see FIG. 6). The shaft 52 is positioned upward relative to the communication port 128. The float 51 and shaft 52 are located within the first chamber 181 of each storage chamber 160.

The arm 53 protrudes substantially upward from the float 51. The detected portion 54 is provided at a protruding tip end portion of the arm 53. That is, the detected portion 54 constitutes a pivoting end portion of the pivoting member 50. A portion of the arm 53 and the detected portion 54 are located in the internal space 120*a* of the projecting portion 120.

The detected portion 54 is positioned upward relative to the communication port 184 of the connecting portion 107. The detected portion 54 has a plate shape extending in the up-down direction 7 and the front-rear direction 8. The detected portion 54 is made of material that can block light emitted from a light-emitting portion 55*a* of the corresponding liquid-level sensor 55 (described later).

While the liquid level of the ink stored in the storage chamber 160 is higher than the position P1 (more specifically, the center of the communication port 184) in the up-down direction 7, in other words, while the liquid level of the ink stored in the storage chamber 57 of the ink cartridge 30 is higher than the position P1 of the ink supply portion 34 (more specifically, the center of the ink supply port 71) in the up-down direction 7, the pivoting member 50 pivotally moves in the direction of the arrow 58 due to buoyancy acting on the float 51. As a result, the pivoting member 50 is positioned at a detection position indicated by a solid line in FIG. 6.

As the ink stored in the storage chamber 160 and in the ink valve chamber 35 is consumed and the liquid level of the ink stored in the storage chamber 57 is lowered to a position equal to the position P1 in the up-down direction 7, the pivoting member 50 pivotally moves in the direction of the arrow 59 following the liquid level (liquid surface) of the ink stored in the storage chamber 160. As a result, the pivoting member 50 moves to a non-detection position indicated by a broken line in FIG. 6. That is, the pivoting member 50 is configured to change its posture (pivot) depending on whether the liquid level of the ink stored in the storage chamber 160 is at the same position (at the same height) as the communication port 184 of the connecting portion 107 in the up-down direction 7.

<Liquid-Level Sensor 55>

The liquid-level sensor 55 (see FIGS. 6, 8 and 10) is provided to detect the change in posture of the corresponding pivoting member 50 including the detected portion 54. In the present embodiment, each liquid-level sensor 55 includes the light-emitting portion 55*a* and a light-receiving portion 55*b* both mounted on a substrate 60. The substrate 60 and liquid-level sensors 55 are configured to detect the residual amount of ink stored in the respective storage chambers 160.

Figure 8:
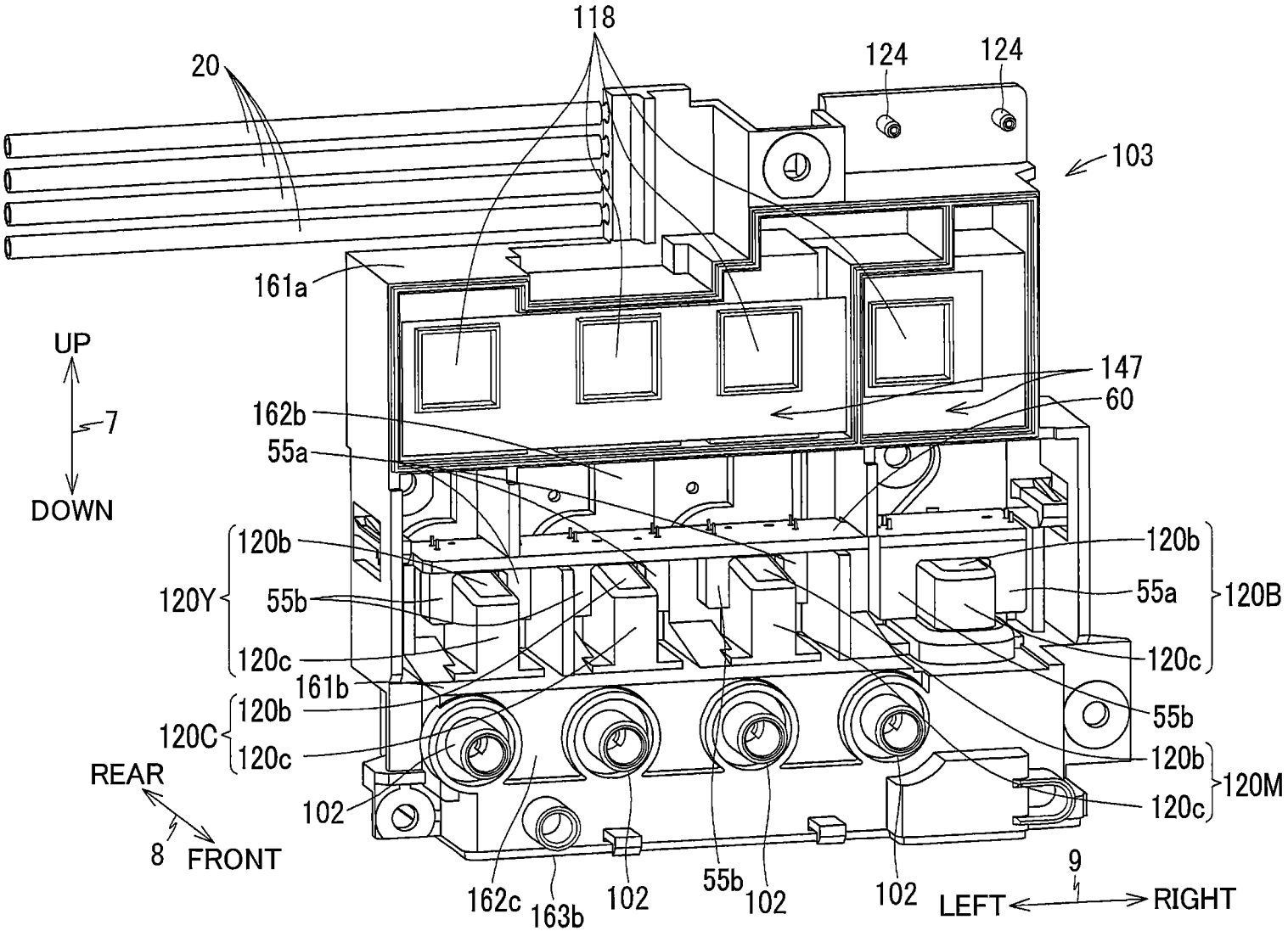
FIG. 8 is a front perspective view of tanks of the cartridge-attachment portion according to the embodiment.

Specifically, as shown in FIGS. 6 and 8, the substrate 60 is disposed above the projecting portions 120 of the four tanks 103. The substrate 60 extends in the left-right direction 9.

The liquid-level sensors 55 are mounted on a lower surface of the substrate 60. Each liquid-level sensor 55 is configured to detect the change in posture of the corresponding pivoting member 50 including the detected portion 54.

The light-emitting portion 55*a* and the light-receiving portion 55*b* of the liquid-level sensor 55 are arranged spaced apart from each other in the left-right direction 9, with the projecting portion 120 of the corresponding tank 103 interposed between the light-emitting portion 55*a* and the light-receiving portion 55*b*. The light-emitting portion 55*a* of the liquid-level sensor 55 is disposed rightward or leftward relative to the projecting portion 120, while the light-receiving portion 55*b* of the liquid-level sensor 55 is disposed at the other side of the light-emitting portion 55*a* relative to the projecting portion 120. A path of light outputted from the light-emitting portion 55*a* of the liquid-level sensor 55 coincides with the left-right direction 9. When the pivoting member 50 is at the detection position, the detected portion 54 is positioned between the light-emitting portion 55*a* and the light-receiving portion 55*b* of the liquid-level sensor 55.

The liquid-level sensor 55 is configured to output detection different signals depending on whether or not the light outputted from the light-emitting portion 55*a* is received by the light-receiving portion 55*b*. For example, the liquid-level sensor 55 is configured to output a low-level signal (a signal whose signal level is lower than a threshold level) to the controller 130 (see FIG. 10) in case that the light-receiving portion 55*b* does not receive the light outputted from the light-emitting portion 55*a* (that is, an intensity of the light received at the light-receiving portion 55*b* is less than a predetermined intensity). On the other hand, the liquid-level sensor 55 is configured to output a high-level signal (a signal whose signal level is equal to or higher than the threshold level) to the controller 130 in case that the light-receiving portion 55*b* receives the light outputted from the light-emitting portion 55*a* (that is, the intensity of the light received at the light-receiving portion 55*b* is equal to or higher than the predetermined intensity).

As illustrated in FIG. 6, the detected portion 54 is positioned between the light-emitting portion 55*a* and the light-receiving portion 55*b* of the corresponding liquid-level sensor 55 when the pivoting member 50 is at the detection position. Thus, in case that the liquid level of the ink stored in the storage chamber 160 of the tank 103 (in other words, the liquid level of the ink stored in the storage chamber 57 of the ink cartridge 30) is higher than the position P1 in the up-down direction 7, the liquid-level sensor 55 outputs the low-level signal to the controller 130 since the light-receiving portion 55*b* does not receive the light outputted from the light-emitting portion 55*a*.

On the other hand, when the pivoting member 50 is at the non-detection position, the detected portion 54 is retracted from the position between the light-emitting portion 55*a* and the light-receiving portion 55*b* of the liquid-level sensor 55. Thus, in case that the liquid level of the ink stored in the storage chamber 160 of the tank 103 (in other words, the liquid level of the ink stored in the storage chamber 57 of the ink cartridge 30) is equal to or lower than the position P1 in the up-down direction 7, the light-receiving portion 55*b* receives the light outputted from the light-emitting portion 55*a*. Accordingly, the liquid-level sensor 55 outputs the high-level signal to the controller 130.

[Ink Cartridge 30]

Figure 9:
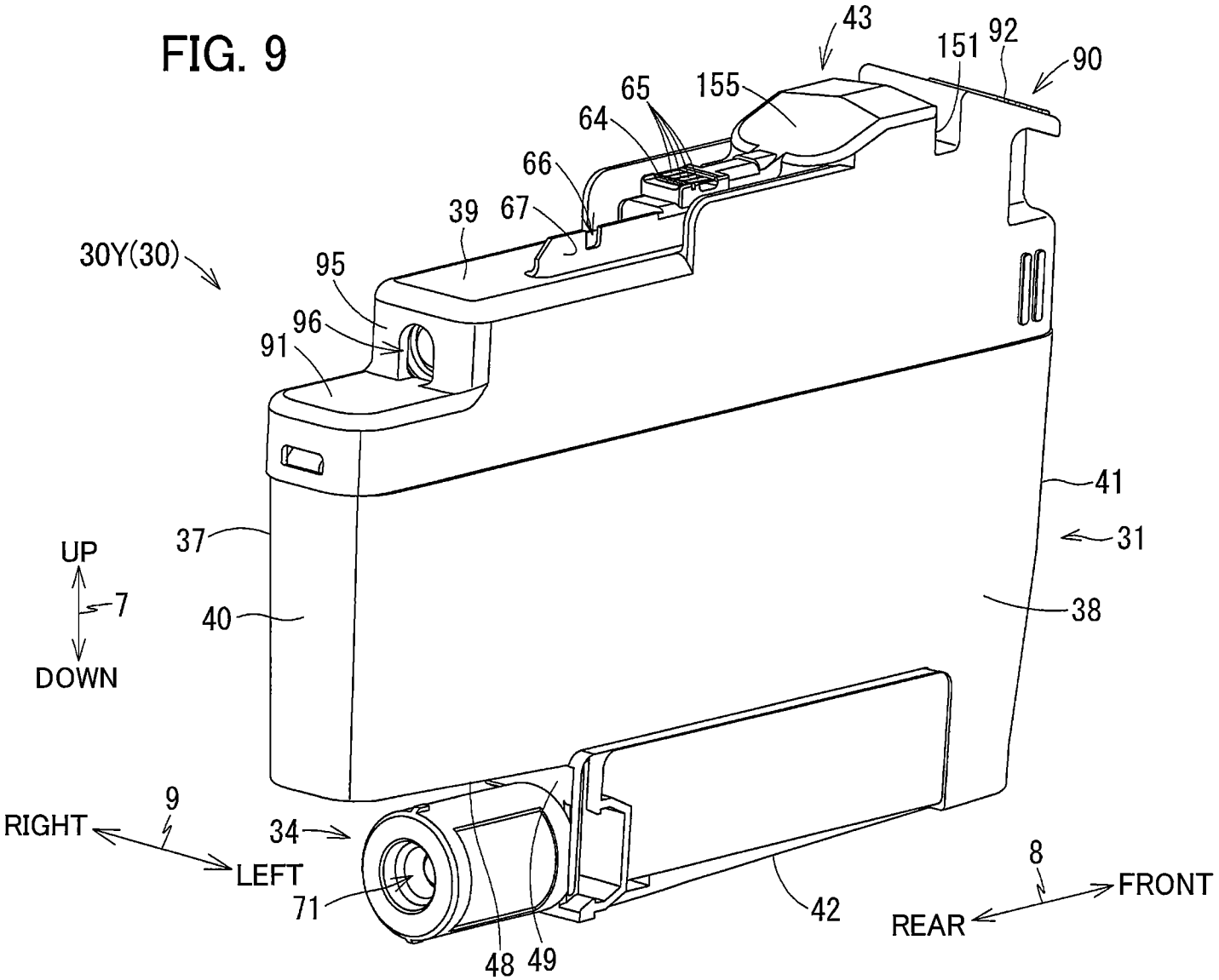
FIG. 9 is a front perspective view of the ink cartridge attachable to the cartridge-attachment portion according to the embodiment.

The ink cartridge 30 illustrated in FIGS. 6 and 9 is a container for storing ink therein. The posture of the ink cartridge 30 illustrated in FIGS. 6 and 9 is the operable posture of the ink cartridge 30, that is, the posture of the ink cartridge 30 when the ink cartridge 30 is capable of being used in the multifunction peripheral 10.

The ink cartridge 30 depicted in FIG. 9 is the ink cartridge 30Y storing ink of yellow color. The ink cartridges 30C and 30M storing ink of cyan and magenta color, respectively, have substantially the same structures as the ink cartridge 30Y, except presence or absence of a cutout 66 and/or position of the cutout 66. The ink cartridge 30B storing black is different from the ink cartridges 30Y, 30C and 30M in that the ink cartridge 30B has a larger dimension than the ink cartridges 30Y, 30C and 30M in the left-right direction 9. Other than the larger left-right dimension, the ink cartridge 30B has substantially the same structure as the ink cartridges 30Y, 30C and 30M, except presence or absence of the cutout 66 and/or position of the cutout 66. Hereinafter, details of the ink cartridge 30Y storing yellow ink will be described as an illustrative example, while descriptions for the ink cartridges 30B, 30C and 30M will be omitted to simplifying description.

As illustrated in FIGS. 6 and 9, the ink cartridge 30(30Y) includes a cartridge casing 31 that is substantially rectangular parallelepiped. The cartridge casing 31 includes a rear wall 40, a step wall 49, a step wall 95, a front wall 41, a top wall 39, a sub-top wall 91, a bottom wall 42, a sub-bottom wall 48, a right side wall 37, and a left side wall 38.

The cartridge casing 31 as a whole has a generally flattened shape so that a dimension of the cartridge casing 31 in the left-right direction 9 is small, and a dimension of the cartridge casing 31 in the up-down direction 7 and a dimension of the cartridge casing 31 in the front-rear direction 8 are greater than the dimension of the cartridge casing 31 in the left-right direction 9. At least the front wall 41 of the cartridge casing 31 has light transmission capability so that the liquid level of the ink stored in a storage chamber 32 (described later) and the storage chamber 33 can be visually recognized from an outside of the cartridge casing 31.

The sub-bottom wall 48 is positioned upward relative to the bottom wall 42 and extends frontward continuously from a lower end of the rear wall 40. In the present embodiment, a rear end of the sub-bottom wall 48 is positioned rearward relative to a rear end of the ink supply portion 34, while a front end of the sub-bottom wall 48 is positioned frontward relative to the rear end of the ink supply portion 34. The step wall 49 connects the bottom wall 42 to the sub-bottom wall 48. The ink supply portion 34 extends rearward from the step wall 49 at a position downward relative to the sub-bottom wall 48 and upward relative to the bottom wall 42. Incidentally, the rear end of the sub-bottom wall 48 may be positioned at an arbitrary position. For example, the rear end of the sub-bottom wall 48 may be positioned frontward relative to the rear end of the ink supply portion 34.

A protruding portion 43 is provided at an outer surface of the top wall 39 to protrude upward therefrom. The protruding portion 43 extends in the front-rear direction 8. The protruding portion 43 has a lock surface 151 facing frontward. The lock surface 151 is positioned upward relative to the top wall 39. The lock surface 151 is configured to contact the lock shaft 145 in a state where the ink cartridge 30 is attached to the cartridge-attachment portion 110. The lock surface 151 comes into contact with the lock shaft 145 while pushing the lock shaft 145 frontward, so that the ink cartridge 30 is held in the cartridge-attachment portion 110 against the urging forces of the coil springs 78 and 98.

The protruding portion 43 also has an inclined surface 155. The inclined surface 155 is positioned rearward relative to the lock surface 151. During an attachment process of the ink cartridge 30 to the cartridge-attachment portion 110, the lock shaft 145 is guided by the inclined surface 155. As the lock shaft 145 moves along the inclined surface 155, the lock shaft 145 is guided to a position capable of contacting the lock surface 151.

An operation portion 90 is disposed frontward relative to the lock surface 151 on the top wall 39. The operation portion 90 has an operation surface 92. When the operation surface 92 is pushed downward in a state where the ink cartridge 30 is attached to the cartridge-attachment portion 110, the ink cartridge 30 is pivotally moved, thereby moving the lock surface 151 downward. As a result, the lock surface 151 is positioned further downward relative to the lock shaft 145. In this way, the ink cartridge 30 can be extracted from the cartridge-attachment portion 110.

The light-blocking plate 67 is provided at the outer surface of the top wall 39 to protrude upward therefrom. The light-blocking plate 67 extends in the front-rear direction 8. The light-blocking plate 67 is disposed rearward relative to the protruding portion 43.

The light-blocking plate 67 is arranged to be located between the light-emitting portion and the light-receiving portion of the attachment sensor 113 in a state where the ink cartridge 30 is attached to the cartridge-attachment portion 110. Hence, the light-blocking plate 67 is configured to block the light of the attachment sensor 113 traveling in the left-right direction 9.

More specifically, when the light emitted from the light-emitting portion of the attachment sensor 113 is incident on the light-blocking plate 67 before the light arrives at the light-receiving portion of the attachment sensor 113, an intensity of the light received by the light-receiving portion is less than a predetermined intensity, for example, zero. Note that the light-blocking plate 67 may completely block the light traveling from the light-emitting portion to the light-receiving portion, or may partially attenuate the light. Alternatively, the light-blocking plate 67 may refract the light to change a traveling direction thereof, or may fully reflect the light.

In the present embodiment, a notch 66 is formed in the light-blocking plate 67, as shown in FIG. 9. The notch 66 is a space that is recessed downward from an upper edge of the light-blocking plate 67, and extends in the front-rear direction 8. Since the notch 66 is formed in the light-blocking plate 67 at a position opposing the attachment sensor 113 in a state where the ink cartridge 30 is attached to the cartridge-attachment portion 110, the light emitted from the light-emitting portion of the attachment sensor 113 passes through the notch 66 and is therefore not blocked by the light-blocking plate 67. Accordingly, the light emitted from the light-emitting portion of the attachment sensor 113 reaches the light-receiving portion of the attachment sensor 113. On the other hand, in case that the notch 66 is not formed in the light-blocking plate 67, the light-blocking plate 67 opposes the light-emitting portion of the attachment sensor 113 in a state where the ink cartridge 30 is attached to the cartridge-attachment portion 110. Accordingly, the light emitted from the light-emitting portion of the attachment sensor 113 does not reach the light-receiving portion of the attachment sensor 113. With this structure, types of the ink cartridges 30, such as types of ink stored in the ink cartridges 30, and initial amounts of ink stored in the ink cartridges 30, can be determined based on whether or not the notch 66 is formed in the light-blocking plate 67 of the ink cartridge 30 attached to the cartridge-attachment portion 110.

An IC board 64 is also provided at the outer surface of the top wall 39. The IC board 64 is positioned between the light-blocking plate 67 and the protruding portion 43 in the front-rear direction 8. The IC board 64 is electrically connected to the corresponding set of four contacts 106 in a state where the ink cartridge 30 is attached to the cartridge-attachment portion 110.

The IC board 64 includes a substrate made of silicon for example, an IC (not illustrated), and four electrodes 65. The IC and the four electrodes 65 are mounted on the substrate. The four electrodes 65 are arrayed in the left-right direction 9. The IC is a semiconductor integrated circuit. The IC readably stores data indicative of information on the ink cartridge 30, such as a lot number, a manufacturing date, a color of ink, and the like. Alternatively, the IC board 64 may be configured by providing the IC and electrodes on a flexible substrate having flexibility.

Each of the four electrodes 65 is electrically connected to the IC. Each of the four electrodes 65 extends in the front-rear direction 8. The electrodes 65 are arranged spaced apart from one another in the left-right direction 9. Each electrode 65 is provided on an upper surface of the IC board 64 and exposed thereon to an outside to allow electrical access to the electrode 65.

The step wall 95 extends upward from a front end of the sub-top wall 91 that is positioned rearward relative to the top wall 39. The step wall 95 is formed with the air communication port 96 to allow the storage chamber 32 to communicate with the atmosphere. In other words, the air communication port 96 is positioned higher relative to the center of the cartridge casing 31 in the up-down direction 7. The air communication port 96 is a substantially circular-shaped opening formed in the step wall 95. The air communication port 96 has an inner diameter that is greater than an outer diameter of the rod 125 of the cartridge-attachment portion 110.

In the attachment process of the ink cartridge 30 into the cartridge-attachment portion 110, the rod 125 enters an air valve chamber 36 (described later) through the air communication port 96. As the rod 125 passes through the air communication port 96, the rod 125 moves a valve 97 configured to seal the air communication port 96 frontward against the urging force of the coil spring 98. As the valve 97 is moved frontward to be separated from the air communication port 96, the storage chamber 32 is open to the atmosphere.

Incidentally, a member for sealing the air communication port 96 should not necessarily be the valve 97. For example, a peel-off seal may be provided at the step wall 95 to seal the air communication port 96.

As illustrated in FIG. 6, the storage chamber 57 and an air flow path 61 are provided within the cartridge casing 31. The storage chamber 57 includes the storage chamber 32, the storage chamber 33, and the ink valve chamber 35. The storage chamber 32 and storage chamber 33 are configured to store ink therein.

Inside the cartridge casing 31, a partition wall 44 and an inner bottom wall 45 are provided. The partition wall 44 and inner bottom wall 45 both extend in the front-rear direction 8 and left-right direction 9. The partition wall 44 and inner bottom wall 45 are arranged to oppose each other in the up-down direction 7.

The storage chamber 32 is a space defined by: a lower surface of the partition wall 44; upper surfaces of the inner bottom wall 45 and sub-bottom wall 48; inner surfaces of the front wall 41, rear wall 40 and step wall 49; and inner surfaces of the right side wall 37 and left side wall 38. Specifically, the lower surface of the partition wall 44 defines an upper edge of the storage chamber 32; the upper surfaces of the inner bottom wall 45 and sub-bottom wall 48 define a lower edge of the storage chamber 32; the inner surfaces of the front wall 41 define a front edge of the storage chamber 32; the inner surfaces of the rear wall 40 and step wall 49 define a rear edge of the storage chamber 32; and the inner surfaces of the right side wall 37 and left side wall 38 define a right edge and a left edge of the storage chamber 32, respectively.

The partition wall 44 separates the storage chamber 32 from the air flow path 61. The partition wall 44 has a front end portion that is formed with a through-hole 46. The storage chamber 32 and the air flow path 61 are in communication with each other through the through-hole 46.

The inner bottom wall 45 extends frontward from the inner surface of the step wall 49. The inner bottom wall 45 partitions the storage chamber 57 into the storage chamber 32 (above the inner bottom wall 45) and the storage chamber 33 (below the inner bottom wall 45). The inner bottom wall 45 has a front end defining a gap 45*a* with the front wall 41 (see FIG. 6). The storage chamber 32 and the storage chamber 33 are in communication with each other through the gap 45*a*.

As illustrated in FIG. 6, the inner bottom wall 45 is positioned upward relative to the ink supply port 71 of the ink supply portion 34.

The storage chamber 33 is located below the storage chamber 32 inside the cartridge casing 31 in the operable posture of the ink cartridge 30. The storage chamber 33 has a volume (a maximum amount of ink that the storage chamber 33 can store therein) that is smaller than a volume of the storage chamber 32 (a maximum amount of ink that the storage chamber 32 can store therein).

A lower surface of the inner bottom wall 45 defines an upper edge of the storage chamber 33. An upper surface of the bottom wall 42 defines a lower edge of the storage chamber 33. The inner surface of the front wall 41 defines a rear edge of the storage chamber 33. The inner surfaces of the right side wall 37 and left side wall 38 define a right edge and a left edge of the storage chamber 33, respectively. A partitioning wall 47 is also formed inside the cartridge casing 31 to separate the storage chamber 33 from the ink valve chamber 35 in the front-rear direction 8. A front surface of the partitioning wall 47 defines a rear edge of the storage chamber 33. The partitioning wall 47 is formed with a through-hole 99.

In other words, the storage chamber 33 is a space defined by the lower surface of the inner bottom wall 45, the upper surface of the bottom wall 42, the inner surface of the front wall 41, the inner surfaces of the right side wall 37 and left side wall 38 and the front surface of the partitioning wall 47. The storage chamber 33 is in communication with the ink valve chamber 35 through the through-hole 99.

The air flow path 61 is configured to allow the storage chamber 57 to communicate with the atmosphere. The air flow path 61 has one end portion (frontward portion) in communication with the storage chamber 32 via the through-hole 46, and another end portion (rearward portion) in communication with the atmosphere via the air communication port 96.

The air valve chamber 36 constitutes the other end portion (rearward portion) of the air flow path 61. Within the air valve chamber 36, the valve 97 and the coil spring 98 are accommodated. The air valve chamber 36 is in communication with the outside through the air communication port 96. The valve 97 is movable between a closed position and an open position. At the closed position, the valve 97 seals the air communication port 96. At the open position, the valve 97 is separated from the air communication port 96. The coil spring 98 is disposed in the air valve chamber 36 so as to be capable of expanding and contracting in the front-rear direction 8. The coil spring 98 urges the valve 97 rearward, i.e., in a direction such that the valve 97 contacts the air communication port 96. The coil spring 98 has a spring constant that is smaller than a spring constant of the coil spring 78 of the ink supply portion 34.

A wall 93 partitions the air valve chamber 36 from the one end portion (frontward portion) of the air flow path 61. The wall 93 is formed with a through-hole 94. The through-hole 94 is sealed with a semi-permeable membrane 80. The air valve chamber 36 is in communication with the one end portion (frontward portion) of the air flow path 61 through the through-hole 94.

The ink supply portion 34 protrudes rearward from the step wall 49. That is, the ink supply portion 34 is provided at the step wall 49. The ink supply portion 34 has a cylindrical outer shape. The ink supply portion 34 has an inner space serving as the ink valve chamber 35. The ink supply portion 34 has a rear end portion that is open to the outside of the ink cartridge 30 through the ink supply port 71. A seal member 76 is provided at the rear end portion of the ink supply portion 34. The ink supply portion 34 has a front end that is in communication with a lower end portion of the storage chamber 33 through the through-hole 99 as described above. That is, the ink supply portion 34 is in communication with the lower end portion of the storage chamber 33. Put another way, the ink supply port 71 is connected to the storage chamber 33 via the ink valve chamber 35 to allow the ink stored in the storage chamber 33 to flow out of the ink supply portion 34 through the ink supply port 71.

The ink valve chamber 35 is defined by inner peripheral surfaces of the ink supply portion 34. Referring to FIG. 6, the inner peripheral surface defining a lower end of the ink supply portion 34 (to be referred as "inner lower end 34*a*") also defines a bottom (lowermost end) of the storage chamber 57. On the other hand, the upper surface of the second lower wall 163*b* defines a bottom (lowermost end) of the storage chamber 160 of the tank 103. The upper surface of the second lower wall 163*b* is positioned downward relative to the inner lower end 34*a* of the ink supply portion 34.

A valve 77 and the coil spring 78 are accommodated in the ink valve chamber 35. The valve 77 is configured to move in the front-rear direction 8 to open and close the ink supply port 71 penetrating a center portion of the seal member 76. The coil spring 78 urges the valve 77 rearward. Accordingly, the valve 77 closes off the ink supply port 71 formed in the seal member 76 in a state where no external force is applied to the valve 77.

The seal member 76 is a disk-shaped member having a center portion formed with a through-hole. The seal member 76 is made of an elastic material such as rubber or elastomer, for example. A cylindrical inner peripheral surface defining the through-hole penetrating the center portion of the seal member 76 in the front-rear direction 8 defines the ink supply port 71. The ink supply port 71 has an inner diameter slightly smaller than an outer diameter of the ink needle 102.

As the ink cartridge 30 is attached to the cartridge-attachment portion 110 in a state where the valve 77 closes off the ink supply port 71 and the valve 114 closes the opening 116 of the ink needle 102, the ink needle 102 enters into the ink supply port 71 in the front-rear direction 8. That is, the connecting portion 107 and the ink supply portion 34 are connected to each other during the attachment process of the ink cartridge 30 to the cartridge-attachment portion 110. At this time, the outer peripheral surface of the ink needle 102 provides liquid-tight contact with the inner peripheral surface of the seal member 76 that defines the ink supply port 71, while elastically deforming the seal member 76. As the tip end of the ink needle 102 passes through the seal member 76 and advances into the ink valve chamber 35, the tip end of the ink needle 102 abuts on the valve 77. As the ink cartridge 30 is further inserted into the cartridge-attachment portion 110, the ink needle 102 moves the valve 77 frontward against the urging force of the coil spring 78, thereby opening the ink supply port 71.

While the tip end of the ink needle 102 abuts on the valve 77, the valve 77 abuts on the valve 114 from a front side thereof and pushes the valve 114 rearward. Hence, the valve 114 moves rearward against the urging force of the coil spring 115, thereby opening the opening 116 of the ink needle 102. As a result, the ink stored in the storage chamber 32, the storage chamber 33 and the ink valve chamber 35 is allowed to low into the storage chamber 160 of the corresponding tank 103 through the internal space 117 of the ink needle 102. Here, each of the storage chamber 32, the storage chamber 33, the ink valve chamber 35 and the storage chamber 160 is open to the atmosphere. Accordingly, the ink stored in the storage chamber 32, the storage chamber 33 and the ink valve chamber 35 of the ink cartridge 30 is supplied to the storage chamber 160 of the corresponding tank 103 through the ink supply portion 34 due to hydraulic head difference.

[Controller 130]

Figure 10:
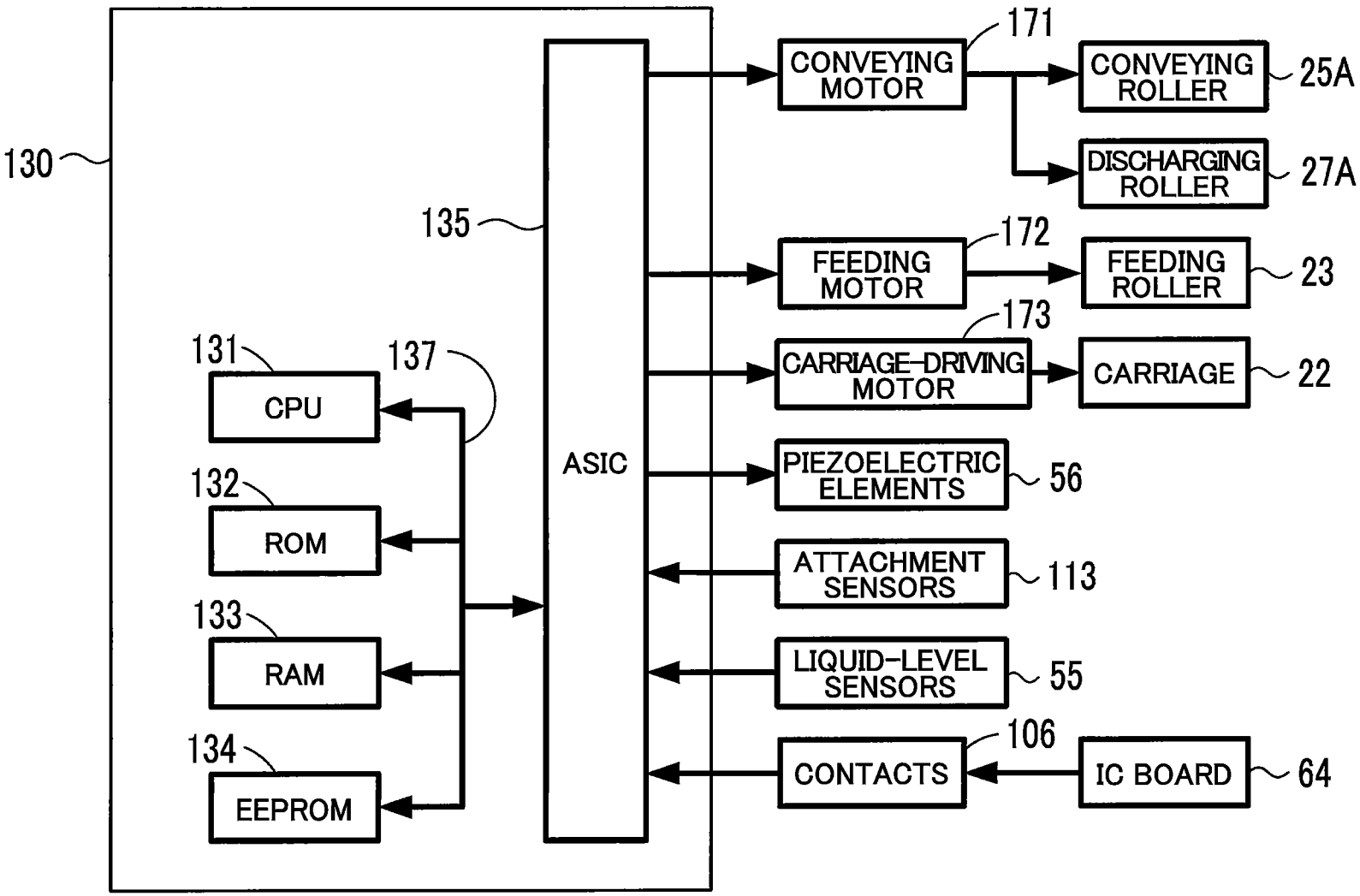
FIG. 10 is a block diagram illustrating a configuration of a controller of the multifunction peripheral according to the embodiment.

Next, an overall configuration of the controller 130 will be described with reference to FIG. 10.

The multifunction peripheral 10 includes the controller 130. The controller 130 is configured to control overall operations of the multifunction peripheral 10. The controller 130 includes a CPU 131, a ROM 132, a RAM 133, an EEPROM 134, an ASIC 135, and an internal bus 137 that connects these components to one another.

The ROM 132 stores programs and the like according to which the CPU 131 can perform various control operations including an image-recording control operation. The RAM 133 is used as a storage area for temporarily storing data, signals, and the like used when the CPU 131 executes the programs. The EEPROM 134 stores settings, flags, and the like that need to be preserved after the multifunction peripheral 10 is turned off.

The conveying motor 171, the feeding motor 172, and the carriage-driving motor 173 are connected to the ASIC 135. The ASIC 135 includes drive circuits for controlling these motors. When the CPU 131 inputs a drive signal for rotating each motor into a corresponding drive circuit thereof, a drive current corresponding to the drive signal is configured to be outputted from the drive circuit to the corresponding motor, thereby rotating the motor. That is, the controller 130 is configured to control rotations of the motors 171, 172 and 173.

Further, the piezoelectric elements 56 are also connected to the ASIC 135. The piezoelectric elements 56 are configured to operate upon receipt of electric power supplied by the controller 130 through a drive circuit (not shown). The controller 130 is configured to control power supply to the piezoelectric elements 56 so that ink droplets can be selectively ejected through the plurality of nozzles 29.

The controller 130 is configured to control the conveying motor 171 to cause the conveying rollers 25 and the discharging rollers 27 to execute an intermittent conveying process when performing image recordation on the sheets 12. The intermittent conveying process is a process in which the conveying rollers 25 and the discharging rollers 27 alternately repeat conveyance of the sheet 12 and halting of the conveyance of the sheet 12 by prescribed line feeds.

The controller 130 is configured to execute an ejection process while halting the conveyance of the sheet 12 in the intermittent conveying process. The ejection process is a process in which the controller 130 controls the power supply to the piezoelectric elements 56 to allow ink droplets to be ejected from the nozzles 29 while moving the carriage 22 in the left-right direction 9. By alternately performing the intermittent conveying process and the ejection process, an image is recorded on each sheet 12.

Further, signals outputted from the respective attachment sensors 113 are configured to be inputted into the ASIC 135. In case that a low signal is inputted from the attachment sensor 113, the controller 130 determines that the ink cartridge 30 has been attached to the cartridge-attachment portion 110. On the other hand, the controller 130 determines that the ink cartridge 30 has not been attached to the cartridge-attachment portion 110 in case that a high level signal is inputted from the attachment sensor 113.

Signals outputted from the respective liquid-level sensors 55 are also configured to be inputted into the ASIC 135. When a low level signal is inputted from the liquid-level sensor 55, the controller 130 determines that the liquid level of the ink stored in the storage chamber 160 of the tank 103 and the liquid level of the ink stored in the ink cartridge 30 are positioned higher than the position P1 in the up-down direction 7.

At a timing when the signal inputted from the liquid-level sensor 55 changes from low level signal to high level signal due to the change in posture of the pivoting member 50, the controller 130 determines that the liquid level of the ink stored in the storage chamber 160 of the tank 103 and the liquid level of the ink stored in the ink cartridge 30 are located at the position P1 in the up-down direction 7.

At this time, the controller 130 is configured to notify a user that: only a small amount of ink is left in the attached ink cartridge 30; or there is too little ink left in the ink cartridge 30 to be supplied to the corresponding tank 103, by means of displaying some kind of warning message on the display 200 (see FIG. 1), lighting an LED light, or emitting a buzzer sound, for example, so that the user can be informed that the ink cartridge 30 needs to be replaced.

Further, the controller 130 is also configured to count how many dots of ink droplets are ejected from the recording head 21 after the signal outputted from the liquid-level sensor 55 to the controller 130 switches from the low level signal to the high level signal. In this case, the controller 130 is configured to determine that the liquid level of the ink stored in the storage chamber 160 of the tank 103 (the liquid level of the ink stored in the corresponding ink cartridge 30) is at a predetermined position lower than the position P1 in the up-down direction 7 when the number (value) of the counted dots is greater than or equal to a predetermined value. Incidentally, the predetermined value is determined on a basis of an internal volume of a portion of the storage chamber 160, the portion being lower than the communication port 184. In the present embodiment, this predetermined position is the position P2 in the up-down direction 7 (see FIGS. 6 and 7). Note that this position P2 may be positioned upward or downward relative to the position shown in FIGS. 6 and 7, provided that the position P2 is lower than the position P1 in the up-down direction 7.

At this time, the controller 130 is configured to stop ejecting ink droplets through the nozzles 29 by controlling the recording portion 24, more specifically, by suspending power supply to the piezoelectric elements 56. Further, the controller 130 is configured to notify the user that only a small amount of ink or little ink is left in the storage chamber 160, that is, the ink cartridge 30 needs to be replaced, by means of displaying some kind of warning message on the display 200 (see FIG. 1), lighting an LED light, or emitting a buzzer sound, for example.

In the present embodiment, the controller 130 is configured to notify the user that little ink is left in the ink cartridges 30 to prompt replacement of the ink cartridge 30 when the signal inputted from the corresponding liquid-level sensor 55 changes from low level to high level. The controller 130 is further configured to stop ejecting ink droplets through the nozzles 29 in addition to the notification to the user, when the counted value of the dots (dot-count value) becomes not less than a prescribed value.

Hereinafter, the above-mentioned notifying process (the first notifying process and second notifying process) executed by the controller 130 will be described with reference to a flowchart of FIG. 11. Through the notifying process, the user is notified that the attached ink cartridge 30 should be replaced.

In an initial state, the value of the counted dots is zero, 0, and the pivoting member 50 is at the detection position. Accordingly, the low level signal is outputted from the liquid-level sensor 55 to the controller 130. The controller 130 therefore determines that the liquid level of the ink stored in the tank 103 and ink cartridge 30 is positioned higher than the position P1 in the up-down direction 7.

Every time image recording is performed on each sheet 12, ink is ejected through the nozzles 29 of the recording head 21. This ink is supplied to the recording head 21 from the tank 103 and ink cartridge 30. The amount of ink stored in the tank 103 and ink cartridge 30 decreases as the more amount of ink is ejected, thereby lowering the liquid level of the ink stored in the tank 103 and ink cartridge 30.

Figure 11:
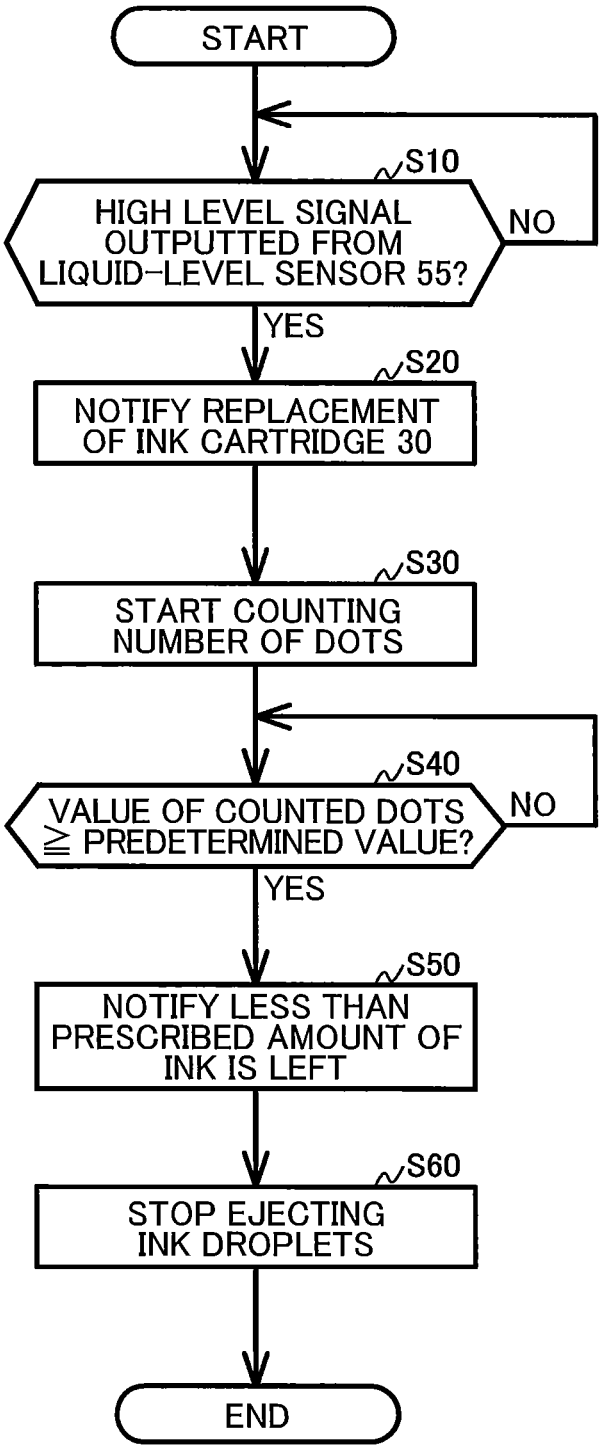
FIG. 11 is a flowchart illustrating steps in a notifying process executed by the controller of the multifunction peripheral according to the embodiment.

Referring to FIG. 11, the controller 130 determines in S10 whether or not the liquid level of the ink stored in the tank 103 and ink cartridge 30 drops to the position P1 in the up-down direction 7. Specifically, the controller 130 determines in S10 whether or not the signal outputted from the corresponding liquid-level sensor 55 changes from low level to high level.

The controller 130 is configured to repeat the step S10 as long as the signal outputted from the liquid-level sensor 55 remains at the low level (S10: NO).

When the liquid level of the ink stored in the tank 103 and ink cartridge 30 is reduced to reach the position P1 and falls below the position P1, the pivoting member 50 pivots from the detection position to the non-detection position in the direction of arrow 59. Thus, the signal outputted from the corresponding liquid-level sensor 55 changes from low level to high level. The controller 130 therefore determines in S10 that the liquid level of the ink stored in the tank 103 and ink cartridge 30 now reaches the position P1 in the up-down direction 7 (S10: YES).

Then, in S20, the controller 130 is configured to notify the user that the attached ink cartridge 30 should be replaced with new one.

Then controller 130 then starts counting the number of dots of ink droplets ejected from the recording head 21 in S30. The value of the counted dots is configured to be stored in the RAM 133. Incidentally, the steps S20 and S30 may be configured to be executed simultaneously.

The controller 130 then determines in S40 whether the counted value of the dots is equal to or greater than the predetermined value. The controller 130 is configured to repeat the step S40 (continue to count the number of dots and store the counted value in the RAM 133) as long as the counted value of the dots is smaller than the predetermined value (S40: NO).

When the counted value of the dots is determined to be equal to or larger than the predetermined value (S40: YES), the controller 130 is then configured to notify the user that the amount of ink stored in the storage chamber 160 becomes smaller than a prescribed amount in S50. In the present embodiment, the prescribed amount is the amount of ink that is stored in the storage chamber 160 when the liquid level of the ink stored therein is at the position P2.

Then controller 130 then stops ejecting the ink droplets through the nozzles 29 of the recording head 21 in S60. Incidentally, the steps S50 and S60 may be configured to be executed simultaneously. Hereinafter, the above-mentioned notifying process (the first notifying process and second notifying process) executed by the controller 130 will be described with reference to a flowchart of FIG. 11. Through the notifying process, the user is notified that the attached ink cartridge 30 should be replaced.

In an initial state, the value of the counted dots is zero, 0, and the pivoting member 50 is at the detection position. Accordingly, the low level signal is outputted from the liquid-level sensor 55 to the controller 130. The controller 130 therefore determines that the liquid level of the ink stored in the tank 103 and ink cartridge 30 is positioned higher than the position P1 in the up-down direction 7.

Every time image recording is performed on each sheet 12, ink is ejected through the nozzles 29 of the recording head 21. This ink is supplied to the recording head 21 from the tank 103 and ink cartridge 30. The amount of ink stored in the tank 103 and ink cartridge 30 decreases as the more amount of ink is ejected, thereby lowering the liquid level of the ink stored in the tank 103 and ink cartridge 30.

Referring to FIG. 11, the controller 130 determines in S10 whether or not the liquid level of the ink stored in the tank 103 and ink cartridge 30 drops to the position P1 in the up-down direction 7. Specifically, the controller 130 determines in S10 whether or not the signal outputted from the corresponding liquid-level sensor 55 changes from low level to high level.

The controller 130 is configured to repeat the step S10 as long as the signal outputted from the liquid-level sensor 55 remains at the low level (S10: NO).

When the liquid level of the ink stored in the tank 103 and ink cartridge 30 is reduced to reach the position P1 and falls below the position P1, the pivoting member 50 pivots from the detection position to the non-detection position in the direction of arrow 59. Thus, the signal outputted from the corresponding liquid-level sensor 55 changes from low level to high level. The controller 130 therefore determines in S10 that the liquid level of the ink stored in the tank 103 and ink cartridge 30 now reaches the position P1 in the up-down direction 7 (S10: YES).

Then, in S20, the controller 130 is configured to notify the user that the attached ink cartridge 30 should be replaced with new one.

Then controller 130 then starts counting the number of dots of ink droplets ejected from the recording head 21 in S30. The value of the counted dots is configured to be stored in the RAM 133. Incidentally, the steps S20 and S30 may be configured to be executed simultaneously.

The controller 130 then determines in S40 whether the counted value of the dots is equal to or greater than the predetermined value. The controller 130 is configured to repeat the step S40 (continue to count the number of dots and store the counted value in the RAM 133) as long as the counted value of the dots is smaller than the predetermined value (S40: NO).

When the counted value of the dots is determined to be equal to or larger than the predetermined value (S40: YES), the controller 130 is then configured to notify the user that the amount of ink stored in the storage chamber 160 becomes smaller than a prescribed amount in S50. In the present embodiment, the prescribed amount is the amount of ink that is stored in the storage chamber 160 when the liquid level of the ink stored therein is at the position P2.

Then controller 130 then stops ejecting the ink droplets through the nozzles 29 of the recording head 21 in S60. Incidentally, the steps S50 and S60 may be configured to be executed simultaneously.

In the present embodiment, the controller 130 is configured to determine the liquid level (position of the liquid surface) of the ink stored in the storage chamber 57 in the up-down direction 7 for each of the four ink cartridges 30. Further, the controller 130 is configured to determine the liquid level (position of the liquid surface) of the ink stored in the storage chamber 160 in the up-down direction 7 for each of the tanks 103 corresponding to the four ink cartridges 30.

Operational and Technical Advantages of the Embodiment

When the liquid surface of the ink stored in the storage chamber 57 of the ink cartridge 30B attached to the cartridge-attachment portion 110 decreases to a height (position) substantially equal to the height (position) of the communication port 184, conceivably, air bubbles enter into the storage chamber 160B from the storage chamber 57. Here, in the storage chamber 160B, the inner wall 167 extends further downward relative to the communication port 184 and detected portion 54, as shown in FIG. 7. Accordingly, the air bubbles coming from the storage chamber 57 do not reach the detected portion 54 and adhere thereto unless the air bubbles move downward and pass through the notch 167*b* formed in the lower end of the inner wall 167. That is, the air bubbles flowing into the storage chamber 160B from the storage chamber 57 cannot reach the detected portion 54 by simply moving horizontally. With this structure of the embodiment, air bubbles flowing out of the storage chamber 57 are less likely to adhere to the detected portion 54 of the pivoting member 50

Further, according to the configuration of the depicted embodiment, the user is prompted to replace the ink cartridge 30 upon detection of the change in posture of the pivoting member 50 (detected portion 54) by the liquid-level sensor 55, while the ink remaining in the storage chamber 160 can be continued to be supplied to the recording portion 24 as long as the value of the counted number of dots of the ink droplets becomes equal to or greater than the prescribed value.

Specifically, the ink stored in the space 193 (see FIGS. 6 and 7) is configured to be consumed until the value of the dot-count become equal to or greater than the prescribed value after the liquid-level sensor 55 detects the change in posture of the pivoting member 50 (detected portion 54). In the meantime, air bubbles also flow into the space 192 (FIG. 7) from the storage chamber 57 of the ink cartridge 30 through the communication port 184 after the liquid-level sensor 55 detects the change in posture of the detected portion 54. Since the volume of the space 192 is larger than the volume of the space 193 in the embodiment, the air bubbles flowing into the space 192 during that period (until the dot-count value becomes equal to or greater than the prescribed value after the liquid-level sensor 55 detects the change in posture of the detected portion 54) are unlikely to go anywhere other than the space 192 in the storage chamber 160. That is, this structure of the embodiment can prevent the air bubbles from reaching the detected portion 54.

Further, in the depicted embodiment, the liquid-level sensor 55 can detect whether or not the liquid surface of the ink stored in the storage chamber 160 is located at the same height or lower than the communication port 184 in the up-down direction 7 by detecting whether or not the detected portion 54 is positioned on the path of light emitted from the light-emitting portion 55*a* toward the light-receiving portion 55*b*.

Further, in the embodiment, the ink needle 102 is thin tubular shaped. Accordingly, air entering inside the ink needle 102 from the storage chamber 57 through the ink supply portion 34 tends to become air bubbles. That is, the configuration of the embodiment is particularly effective in suppressing adherence of air bubbles to the detected portion 54 of the pivoting member 50.

In the depicted embodiment, the communication port 128 is provided to communicate with the storage chamber 160 at a position lower than the notch 167*b* formed in the lower end of the inner wall 167 in the up-down direction 7. Accordingly, substantially all of the ink stored in the storage chamber 160 can be supplied to the recording portion 24.

[Modifications and Variations]

While the description has been made in detail with reference to the embodiment thereof, it would be apparent to those skilled in the art that many modifications and variations may be made therein without departing from the scope of the disclosure.

For example, in the depicted embodiment, the communication port 128 is formed at a position corresponding to the lower end, right end and front end of the storage chamber 160. However, the communication port 128 may not necessarily be formed at this position.

Further, in the storage chamber 160 of the depicted embodiment, the buffer chamber 180 and first chamber 181 are formed to protrude further frontward relative to the second chamber 182. However, the buffer chamber 180 and first chamber 181 do not necessarily protrude frontward, but may protrude further rearward relative to the second chamber 182.

Still further, while the attachment sensor 113 and the liquid-level sensor 55 are optical sensors each having the light-emitting portion and the light-receiving portion in the embodiment, the attachment sensor 113 and the liquid-level sensor 55 may be sensors of a different type from the optical sensor, such as a proximity sensor.

In the embodiment, the controller 130 is configured to detect that the liquid level of the ink stored in the storage chamber 160 falls below the position P1 by the pivotal movement of the pivoting member 50 disposed within the storage chamber 160 of each tank 103. However, the liquid level of the ink stored in the storage chamber 160 may be configured to be detected by a mechanism other than the pivoting of the pivoting member 50.

For example, a prism may be disposed at the storage chamber 160 of each tank 103 at the same height as the position P1. Whether or not the liquid level of the ink stored in the storage chamber 160 of the tank 103 is higher than the position P1 may be determined on a basis of a travelling direction of light incident on the prism that may vary depending on whether or not the liquid level is higher than the prism, that is, on a basis of transmission status of the light incident on the prism. In this example, the prism is an example of a detected portion, and an optical sensor configured to irradiate light on the prism is an example of a detector configured to detect the detected portion. Further, change in light transmission status of the light incident on the prism (detected portion) is an example of change in state of the detected position.

Alternatively, a light-transmission portion may be provided in the storage chamber 160 and an optical sensor may be disposed outside of the storage chamber 160. More specifically, the light-transmission portion may be at least a portion of the walls constituting the tank main body of the tank 103, the portion being formed by material capable of transmitting light and being located at least at the same height as the position P1 in the up-down direction 7. Whether or not the liquid level of the ink stored in the storage chamber 160 of the tank 103 is at the same height as or lower than the position P1 may be determined on a basis of whether or not light incident on the light-transmission portion of the tank 103 may be received at a light-receiving portion of the optical sensor without being attenuated by the ink stored in the storage chamber 160 while passing through the storage chamber 160. Here, whether the light incident on the light-transmission portion of the tank 103 may be received at the light-receiving portion of the optical sensor may vary depending on whether or not the liquid level is higher than a light-emitting portion of the optical sensor. That is, whether or not the liquid level of the ink stored in the storage chamber 160 is at a position equal to or lower than the position P1 may be determined based on by how much the light incident on the light-transmission portion of the tank 103 may be attenuated by the ink stored in the storage chamber 160 while passing through the storage chamber 160, that is, based on attenuation status of the light incident on the light-transmission portion of the tank 103. For example, the light-receiving portion may receive the incident light without being attenuated by the ink stored in the storage chamber 160; or may not receive the light attenuated by the ink; or may not receive the incident light at all. In this example, the light-transmission portion is an example of the detected portion, and the optical sensor is an example of a detector configured to detect the detected portion. Further, change in attenuation status of the light incident on the light-transmission portion (detected portion) is an example of change in state of the detected position.

Still alternatively, for example, two electrodes may be disposed in the storage chamber 160 of each tank 103. One of the two electrodes may have a lower end at a position slightly higher than the position P1, while the other of the two electrodes may have a lower end at a position below the position P1. Whether the liquid level of the ink stored in the storage chamber 160 of the tank 103 is lower than or equal to the position P1 may be determined depending on whether or not current flows between the two electrodes through the ink. In this example, the two electrodes are an example of the detected portion, and a circuit mounted on a substrate configured to detect the current is an example of the detector. Further, change in state of the current flowing between the two electrodes (detected portion) is an example of change in state of the detected position.

Still further, in the depicted embodiment, the through-hole 119 is sealed by the semi-permeable membrane 118. However, the through-hole 119 may not be sealed with the semi-permeable membrane 118. Likewise, while the through-hole 94 is sealed by the semi-permeable membrane 80 in the embodiment, the through-hole 94 may not be sealed by the semi-permeable membrane 80.

Still further, the ink cartridge 30 is configured to be attached to the cartridge-attachment portion 110 by being inserted into the cartridge-attachment portion 110 in the horizontal direction. However, the ink cartridge 30 may be attached to the cartridge-attachment portion 110 by being inserted into the cartridge-attachment portion 110 in a direction other than the horizontal direction, for example, in the up-down direction 7.

While ink serves as an example of liquid in the depicted embodiment, a pretreatment liquid that is ejected onto the recording paper prior to the ink during an image recording operation, for example, may be stored in the ink cartridge 30 and the tank 103, in place of the ink. Alternatively, water that is used for cleaning the recording head 21 may be stored in the ink cartridge 30 and the tank 103.

REMARKS

The multifunction peripheral 10 is an example of an image-recording apparatus. The ink cartridge 30 is an example of a cartridge. The storage chamber storage chamber 57 is an example of a first storage chamber. The air communication port 96, air flow path 61, through-hole 94, semi-permeable membrane 80 and through-hole 46 are an example of a first air communication passage. The ink is an example of liquid. The tank 103 is an example of a tank. The storage chamber 160B is an example of a second storage chamber. The air communication port 124, air flow path 147, through-hole 119 and semi-permeable membrane 118 are an example of a second air communication passage. The communication port 184 is an example of a liquid inlet port. The communication port 128 is an example of a liquid outlet port. The recording portion 24 is an example of a recording portion. The detected portion 54 of the pivoting member 50 is an example of a detected portion. The liquid-level sensor 55 is an example of a detector. The inner wall 167 is an example of a wall portion. The gap 167*a* is an example of an upper communication portion. The through-hole 267*a* is another example of the upper communication portion. The notch 167*b* is an example of a lower communication portion. The through-hole 267*b* is another example of the lower communication portion. The space 192 of the storage chamber 160B is an example of a first space. The space 193 of the storage chamber 160B is an example of a second space. The controller 130 is an example of a controller. The ink needle 102 is an example of a needle.

What is claimed is:

1. An image-recording apparatus comprising:

a tank connectable to a replaceable cartridge and comprising:

a liquid inlet port defining an axis extending in a first horizontal direction that is connectable to the replaceable cartridge, the liquid inlet port and the replaceable cartridge being in communication with each other in a state where the replaceable cartridge is connected to the liquid inlet port to allow liquid stored in the replaceable cartridge to be introduced through the liquid inlet port;

a storage chamber configured to store the liquid introduced thereinto from the replaceable cartridge through the liquid inlet port;

a wall portion extending in a vertical direction to partition an inner space of the storage chamber into a first region and a second region adjacent one another in a second horizontal direction perpendicular to the first horizontal direction, the liquid inlet port being provided in the first region;

an upper communication portion at an upper end of the wall portion above the inlet port that allows the first region and the second region to communicate with one another;

a lower communication portion at a lower end of the wall portion below the inlet port that allows the first region and the second region to communicated with one another; and a liquid outlet port configured to discharge the liquid stored in the storage chamber to flow out therefrom;

a recording portion comprising a nozzle through which the liquid supplied from the storage chamber through the liquid outlet port is configured to be ejected in a form of liquid droplets;

a detected portion disposed in the second region of the storage chamber between the upper communication portion and the lower communication portion in the vertical direction, the detected portion being configured to change in state in a case where a liquid level of the liquid stored in the storage chamber becomes equal to or lower than a threshold level in the vertical direction; and a detector configured to detect change in state of the detected portion and output a detection signal upon detection of the change.

2. The image-recording apparatus according to claim 1, further comprising a controller configured to:

perform counting a number of dots of liquid droplets ejected through the nozzle after receipt of the detection signal from the detector; and control the recording portion to stop ejection of the liquid droplets through the nozzle in a case where a value indicative of the number of the dots counted in the counting becomes equal to or greater than a predetermined value, wherein the storage chamber includes a first space and a second space, the first space being positioned in the first region and spanning between a center of the liquid inlet port and an upper edge of the wall portion, the second space being positioned lower than the center of the liquid inlet port and higher than the liquid level of the liquid stored in the storage chamber at a time of execution of the stopping the ejection of the liquid droplets through the nozzle, the first space having a volume greater than a volume of the second space.

3. The image-recording apparatus according to claim 1, wherein the detector comprises a light-emitting portion and a liquid-receiving portion facing the light emitting portion, the detected portion being configured to be at a detection position interposed between the light-emitting portion and the light-receiving portion; and wherein the detected portion is configured to retract from the detection position in the case where the liquid level of the liquid stored in the storage chamber becomes equal to or lower than the threshold level in the vertical direction.

4. The image-recording apparatus according to claim 1, wherein the tank further comprises a tubular needle in communication with the liquid inlet port and extending in the first horizontal direction; and wherein the replaceable cartridge is movable in the first horizontal direction to be connected to the needle.

5. The image-recording apparatus according to claim 1, wherein the liquid outlet port is arranged in the second region at a position lower than the lower communication portion in the vertical direction.

6. The image-recording apparatus according to claim 1, wherein the tank further includes an upper wall defining an upper end of the storage chamber in the vertical direction; and wherein the wall portion has an upper edge in the vertical direction, the upper communication potion being a gap defined between the upper wall and the upper edge of the wall portion in the vertical direction.

7. The image-recording apparatus according to claim 1, wherein the lower communication portion is a notch formed in the lower end portion of the wall portion.

8. The image-recording apparatus according to claim 1, wherein the recording portion is movable relative to the tank.

9. The image-recording apparatus according to claim 1, wherein the liquid outlet port is provided at the second region of the storage chamber.

10. The image-recording apparatus according to claim 1, wherein the tank comprises:

an upper wall defining an upper end of the storage chamber;

a bottom wall defining an upper end of the storage chamber; and a side wall connecting the upper wall to the bottom wall, wherein the liquid inlet port is provided at the side wall.

11. An image-recording apparatus comprising:

a tank connectable to a replaceable cartridge and comprising:

a liquid inlet port defining an axis extending in a first horizontal direction that is connectable to the replaceable cartridge, the liquid inlet port and the replaceable cartridge being in communication with each other in a state where the replaceable cartridge is connected to the liquid inlet port to allow liquid stored in the replaceable cartridge to be introduced through the inlet port;

a storage chamber configured to store the liquid introduced thereinto from the replaceable cartridge through the liquid inlet port;

a wall portion extending in a vertical direction to partition an inner space of the storage chamber into a first region and a second region adjacent one another in a second horizontal direction perpendicular to the first horizontal direction, the liquid inlet port being provided in the first region;

a communication portion at a lower end of the wall portion below the inlet port in the vertical direction that allows the first region and the second region to communicated with one another; and a liquid outlet port positioned above the communication portion in the vertical direction and configured to discharge the liquid stored in the storage chamber to flow out therefrom;

a recording portion comprising a nozzle through which the liquid supplied from the storage chamber through the liquid outlet port is configured to be ejected in a form of liquid droplets;

a detected portion disposed in the second region of the storage chamber above the communication portion in the vertical direction, the detected portion being configured to change in state in a case where a liquid level of the liquid stored in the storage chamber becomes equal to or lower than a threshold level in a vertical direction;

a detector configured to detect change in state of the detected portion and output a detection signal upon detection of the change.

12. The image-recording apparatus according to claim 11, further comprising a controller configured to:

perform counting a number of dots of liquid droplets ejected through the nozzle after receipt of the detection signal from the detector; and control the recording portion to stop ejection of the liquid droplets through the nozzle in a case where a value indicative of the number of the dots counted in the counting becomes equal to or greater than a predetermined value, wherein the storage chamber includes a first space and a second space, the first space being positioned in the first region and spanning between a center of the liquid inlet port and an upper edge of the wall portion, the second space being positioned lower than the center of the liquid inlet port and higher than the liquid level of the liquid stored in the storage chamber at a time of execution of the stopping the ejection of the liquid droplets through the nozzle, the first space having a volume greater than a volume of the second space.

13. The image-recording apparatus according to claim 11, wherein the detector comprises a light-emitting portion and a liquid-receiving portion facing the light emitting portion, the detected portion being configured to be at a detection position interposed between the light-emitting portion and the light-receiving portion; and wherein the detected portion is configured to retract from the detection position in the case where the liquid level of the liquid stored in the storage chamber becomes equal to or lower than the threshold level in the vertical direction.

14. The image-recording apparatus according to claim 11, wherein the tank further comprises a tubular needle in communication with the liquid inlet port and extending in the first horizontal direction; and wherein the replaceable cartridge is movable in the first horizontal direction to be connected to the needle.

15. The image-recording apparatus according to claim 11, wherein the liquid outlet port is arranged in the second region at a position lower than the communication portion in the vertical direction.

16. The image-recording apparatus according to claim 11, wherein the communication portion is a notch formed in the lower end portion of the wall portion.

17. The image-recording apparatus according to claim 11, wherein the recording portion is movable relative to the tank.

18. The image-recording apparatus according to claim 11, wherein the liquid outlet port is provided at the second region of the storage chamber.

19. The image-recording apparatus according to claim 11, wherein the tank comprises:

an upper wall defining an upper end of the storage chamber;

a bottom wall defining an upper end of the storage chamber; and a side wall connecting the upper wall to the bottom wall, wherein the liquid inlet port is provided at the side wall.

* * * * *